US012606400B2

(12) United States Patent
Schalk et al.

(10) Patent No.: US 12,606,400 B2
(45) Date of Patent: Apr. 21, 2026

(54) DEVICE AND METHOD FOR PROCESSING A STRAND OF CUSHIONING MATERIAL, AND CUSHIONING MATERIAL COIL

(71) Applicant: Sprick GmbH Bielefelder Papier-und Wellpappenwerke & Co., Bielefeld (DE)

(72) Inventors: Bastian Schalk, Detmold (DE); Saskia Lux, Detmold (DE); Tim Matzke, Herford (DE); Vitali Krebs, Ahlen (DE); Marco Schwarberg, Melle (DE)

(73) Assignee: Sprick GmbH Bielefelder Papier- und Wellpappenwerke & Co., Bielefeld (DE)

( * ) Notice: Subject to any disclaimer, the term of this patent is extended or adjusted under 35 U.S.C. 154(b) by 617 days.

(21) Appl. No.: 17/786,811

(22) PCT Filed: Dec. 21, 2020

(86) PCT No.: PCT/EP2020/087502
§ 371 (c)(1),
(2) Date: Dec. 20, 2022

(87) PCT Pub. No.: WO2021/123444
PCT Pub. Date: Jun. 24, 2021

(65) Prior Publication Data

US 2023/0130138 A1 Apr. 27, 2023

(30) Foreign Application Priority Data

Dec. 20, 2019 (DE) ..... 10 2019 135 610.5

(51) Int. Cl.
*B65H 19/29* (2006.01)
*B65D 81/05* (2006.01)
*B65H 35/00* (2006.01)

(52) U.S. Cl.
CPC ..... *B65H 19/29* (2013.01); *B65D 81/05* (2013.01); *B65H 35/0013* (2013.01);
(Continued)

(58) Field of Classification Search
CPC ..... B65H 19/29; B65H 35/0013; B65H 2301/41246; B65H 2301/414422; B65H 2701/1944; B65D 81/05; B31D 5/006
See application file for complete search history.

(56) References Cited

U.S. PATENT DOCUMENTS 5,425,512 A 6/1995 Bichot et al.
6,626,813 B1 * 9/2003 Ratzel ..... B65H 18/08 493/464

(Continued)

FOREIGN PATENT DOCUMENTS

DE 102018107156 A1 * 9/2019 ..... B31D 5/0047

OTHER PUBLICATIONS

English Translation of Written Opinion in PCT/EP2929/087502, mailed on May 3, 2021 (Year: 2021).*
Nov 4, 2025 (EP) Office Action—App. 20839311.6.

*Primary Examiner* — George R Koch
(74) *Attorney, Agent, or Firm* — Banner & Witcoff, Ltd.

(57) ABSTRACT

An apparatus for processing a strand of dunnage material, such as a coil of dunnage material, may include a winding device configured to wind the strand of dunnage material around a winding center, and an adhesive tape dispenser aligned with the winding device. The adhesive tape dispenser may be configured such that the adhesive tape dispensed by the dispenser is applied to an outer end layer of the strand of dunnage material when the outer end layer is wound around the winding center. The dunnage material
(Continued)

may be produced by a dunnage forming machine from a web-shaped starting material, such as a roll or a leporello stack, for example of paper.

34 Claims, 10 Drawing Sheets

(52) U.S. Cl.
CPC ..... *B65H 2301/41246* (2013.01); *B65H 2301/414422* (2013.01); *B65H 2701/1944* (2013.01)

(56) References Cited

U.S. PATENT DOCUMENTS

2016/0001519 A1* 1/2016 Winkens ..... B65H 18/08 156/361
2021/0086466 A1* 3/2021 Schalk ..... B31D 5/0047

* cited by examiner

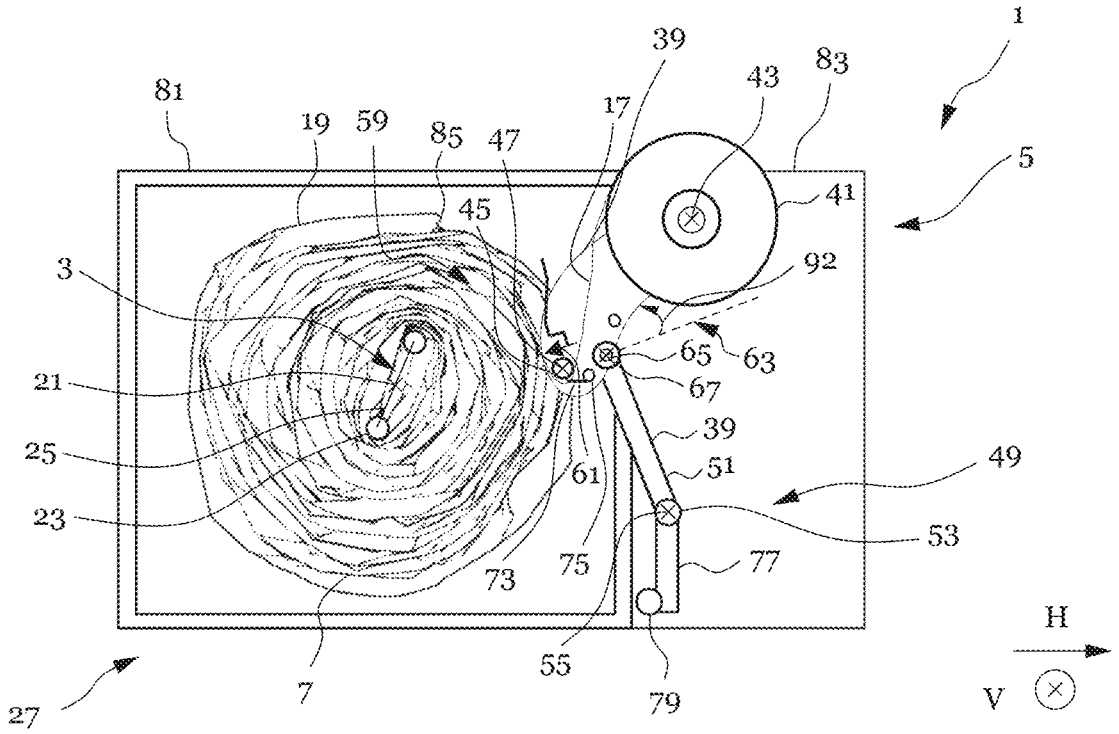
Fig. 9
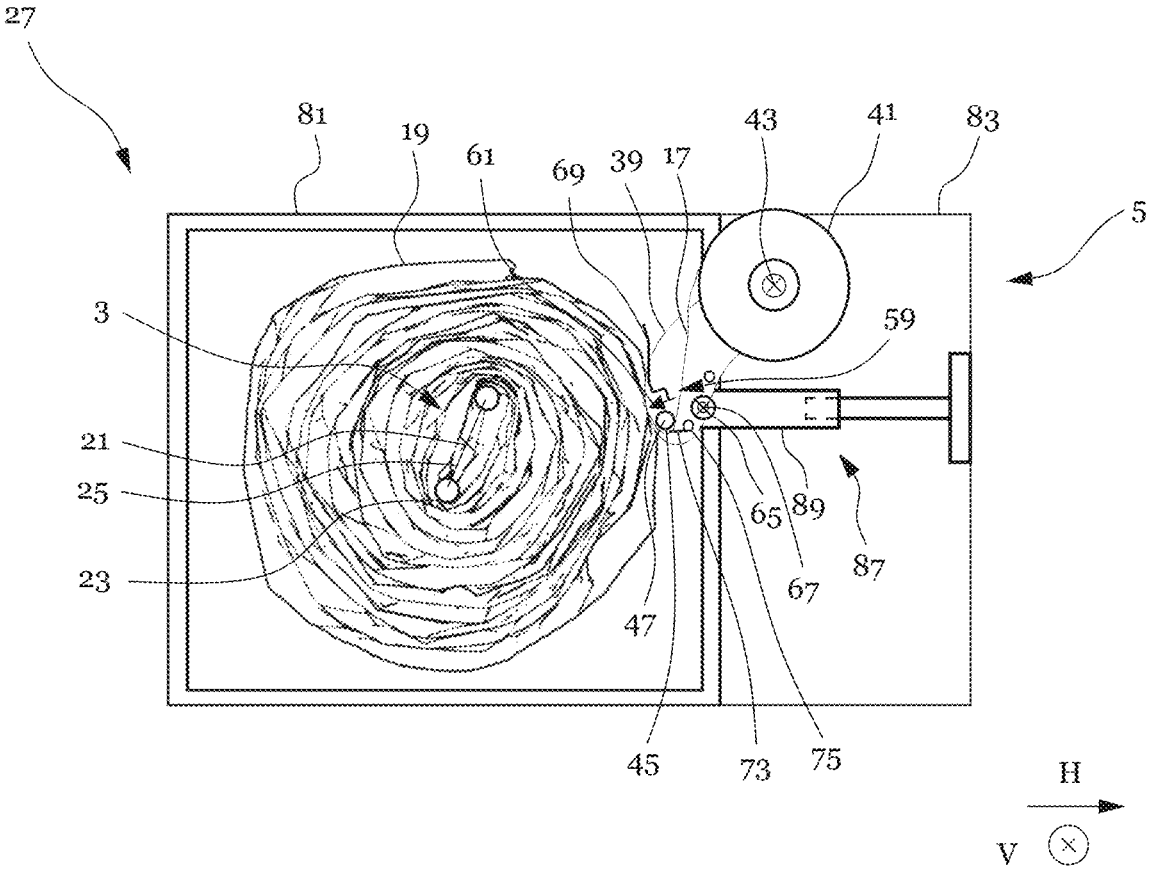
Fig. 10.1

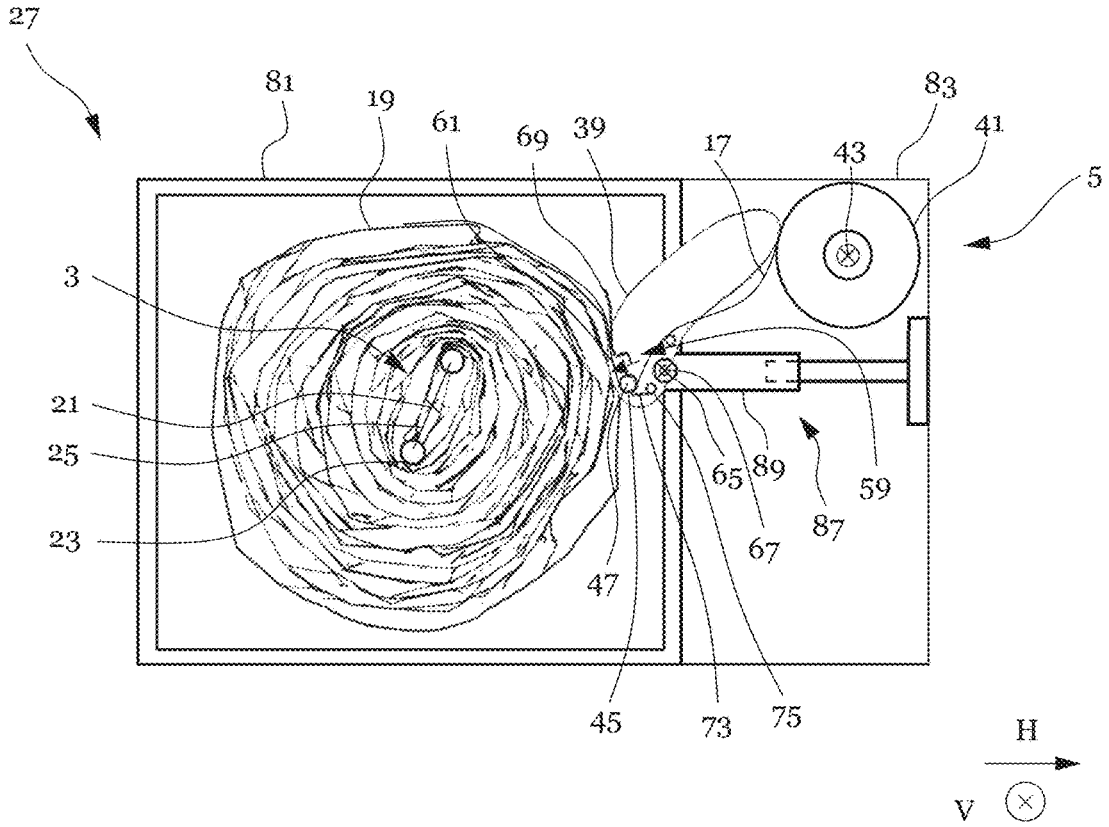
Fig. 10.2
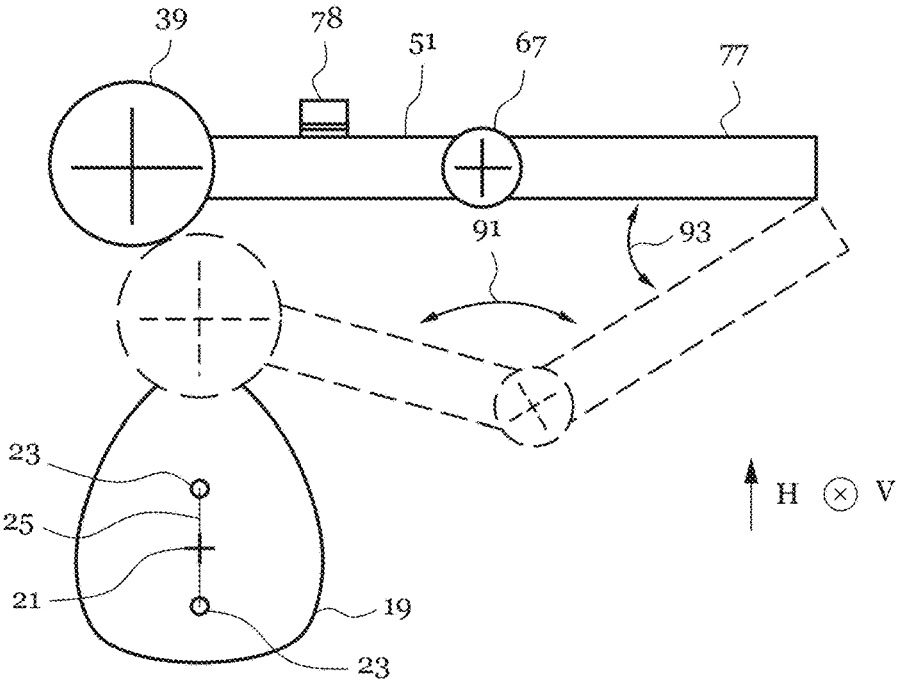
Fig. 11

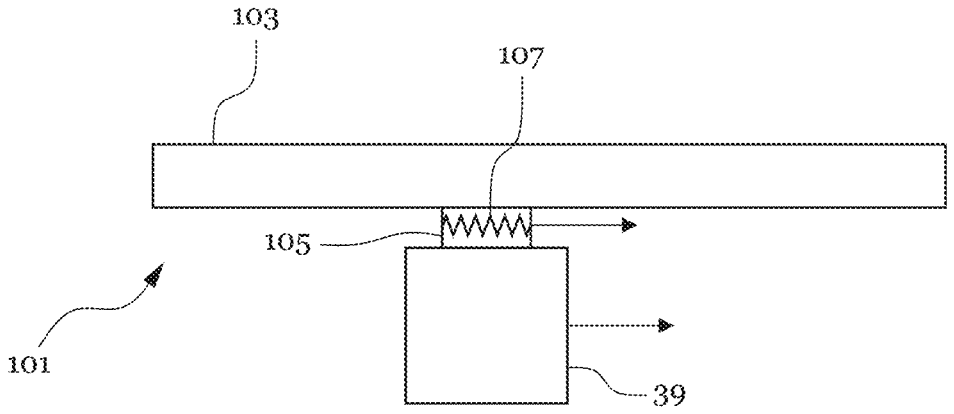
Fig. 14.1
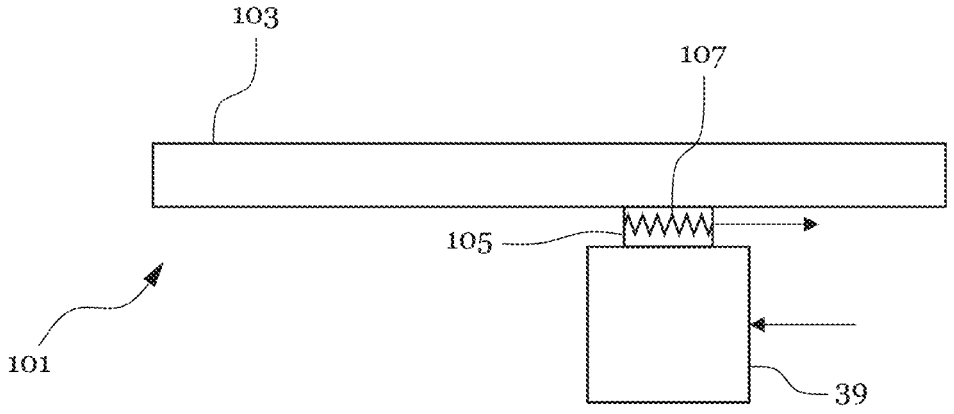
Fig. 14.2
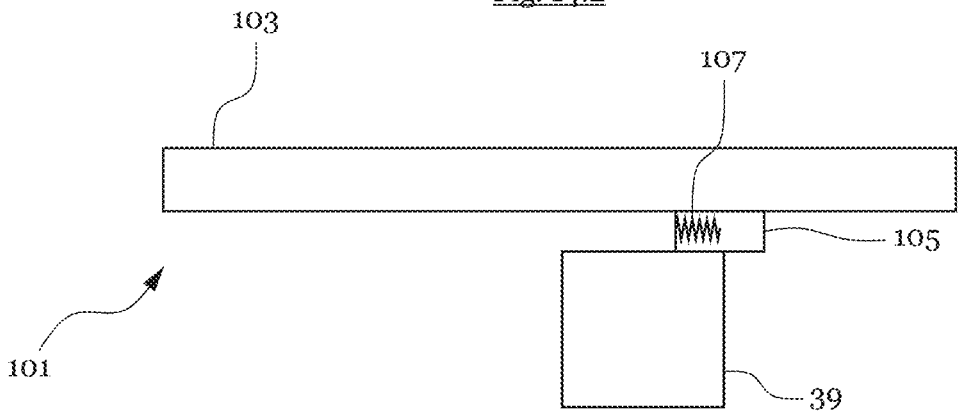
Fig. 14.3

DEVICE AND METHOD FOR PROCESSING A STRAND OF CUSHIONING MATERIAL, AND CUSHIONING MATERIAL COIL

CROSS REFERENCE TO RELATED APPLICATIONS

This patent application is a U.S. National Stage Application of PCT/EP2020/087502, filed Dec. 21, 2020, which claims priority to German Patent Application No. 102019135610.5, filed Dec. 20, 2019, each of which is incorporated herein by reference in its entirety.

BACKGROUND

Field

The disclosure relates to a device and a method for processing a strand of dunnage material. In this context, processing is to be understood in particular as the processing of the strand of dunnage material into a coil of dunnage material. Furthermore, the present disclosure relates to a coil of dunnage material. A coil of dunnage material comprises a wound dunnage material strand and an adhesive tape applied to an outer end layer of the dunnage material strand and extending in the longitudinal direction of the dunnage material strand, for securing the outer end layer to the coil of dunnage material. Dunnage material strand shall, in particular, be understood to mean a three-dimensional paper dunnage product made in a dunnage forming machine from a web-shaped starting material, in particular a roll or a leporello stack, for example of paper.

Related Art

Devices for processing strands of dunnage material into coils of dunnage material are known, for example, from EP 3 159 291 B1. Therein, the device comprises a dunnage forming machine for forming a web-shaped starting material into a dunnage material strand and a winding device for winding the dunnage material strand around a winding center. For this purpose, the winding device comprises two tines extending in the horizontal direction between which the strand of dunnage material is conveyed and which rotate about a horizontal axis to wind the strand of dunnage material around the winding center. Furthermore, an adhesive tape dispensing device is provided for bonding the outer end layer of the strand of dunnage material to the coil of dunnage material. For this purpose, a device for applying the adhesive tape to the upholstery material strand is arranged between the winding device and the upholstery forming machine. For this purpose, an adhesive tape end is unwound from the adhesive tape roll and deposited on a counter plate of the application device extending in the horizontal direction, the adhesive tape surface being directed in the vertical direction with respect to the upholstery material strand, which is conveyed at a vertical distance over the adhesive surface of the adhesive tape end.

Before the outer end layer of the dunnage material strand is wound around the winding center, the winding process is paused, the dunnage material strand is cut, the downstream end of the dunnage material strand is pressed against the adhesive tape end by a vertical lifting device, and the winding process is then continued so that the end of the dunnage material strand is also wound around the winding center. At the same time, the winding process is continued by a certain rotational movement in order to adhere the dunnage material strand end to the coil of dunnage material. Finally, the winding process is interrupted again, the adhesive tape is cut at the horizontal counter plate by vertical displacement of a separating device, and the downstream end of the adhesive tape is wound around the winding center by continuing the winding process again. To ensure that the downstream end of the adhesive tape is also pressed against the pad material winding, a spring plate extending in the horizontal direction is provided downstream of the counter plate to support the adhesive tape on its way between the counter plate and the winding device and press it against the winding device. After the second end is also attached to the coil of dunnage material, a vertically extending ejector plate is moved along the winding axis of the winding device to strip the coil of dunnage material from the tines of the winding device.

A disadvantage of the known device is the complexity of the same, which is associated with the large number of drives used and which leads to increased manufacturing and maintenance costs. Another disadvantage is that the processing speed is increased by stopping the winding operation to press the adhesive tape against the strand of dunnage material and to strip the adhesive tape. Stripping the coil of dunnage material also limits the processing speed. Furthermore, in the known device, the adhesive tape requirement can only be adjusted to a limited extent as a function of the size of the coil of dunnage material, since, for example, the distance between the counter plate for applying the adhesive tape and the winding device always causes an adhesive tape overrun, regardless of the size of the coil of dunnage material. In addition, the rotating tines of the known winding device have been found to pose a considerable risk of injury to persons operating the device.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

FIG. 9 is an alternative schematic representation of the processing state in FIG. 6, according to an exemplary embodiment of the disclosure.

Figure 6:
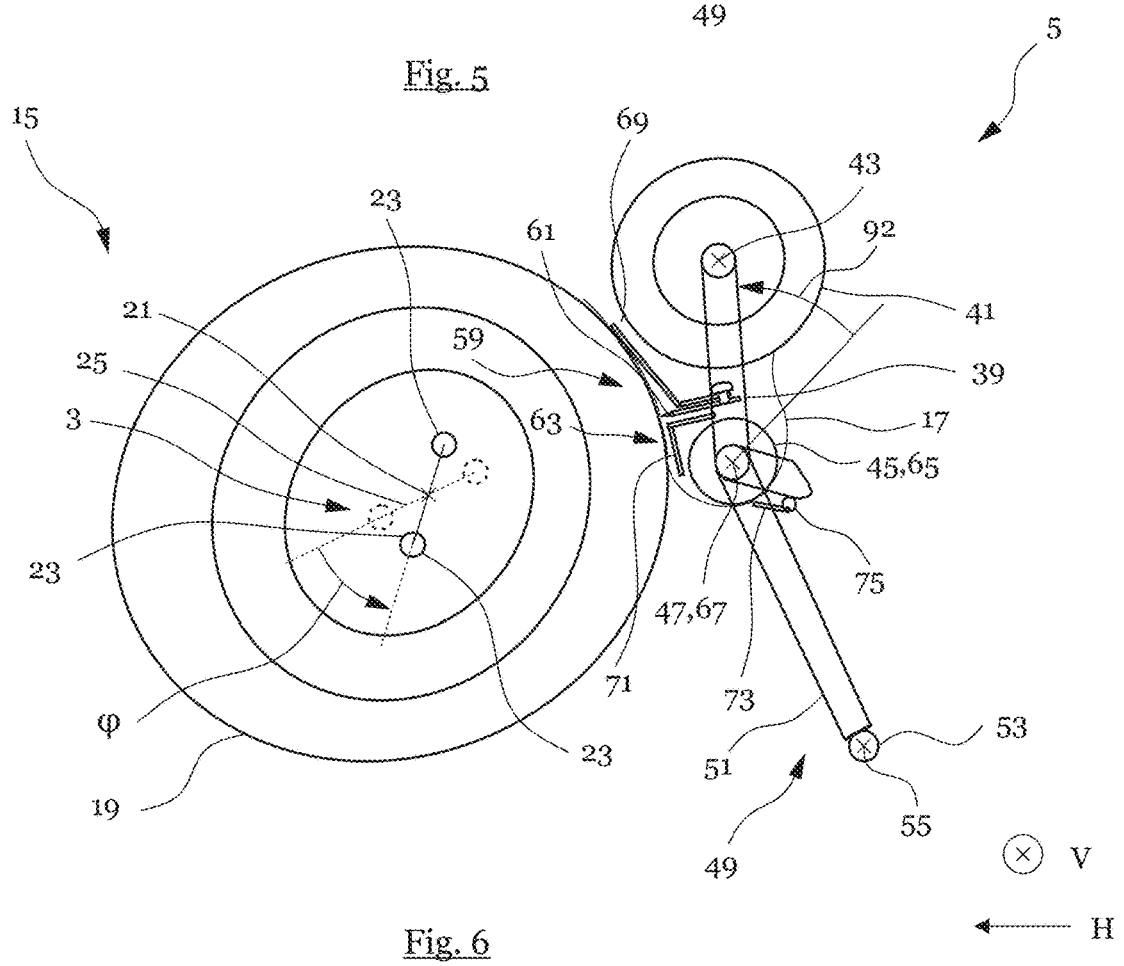
FIG. 6 is a schematic representation of a winding device and an adhesive tape dispensing device, according to an exemplary embodiment of the disclosure, in which the adhesive tape head is pivoted around the severing device to the outer end layer.

FIG. 10.1 is a schematic representation of a processing state as shown in FIGS. 6 and 9, according to an exemplary embodiment of the disclosure.

FIG. 10.2 is the schematic representation from FIG. 10.1, where the adhesive tape supply is decoupled from the adhesive tape head, according to an exemplary embodiment of the disclosure.

FIG. 11 is an adhesive tape pivoting mechanism according to an exemplary embodiment of the disclosure.

Figure 12:
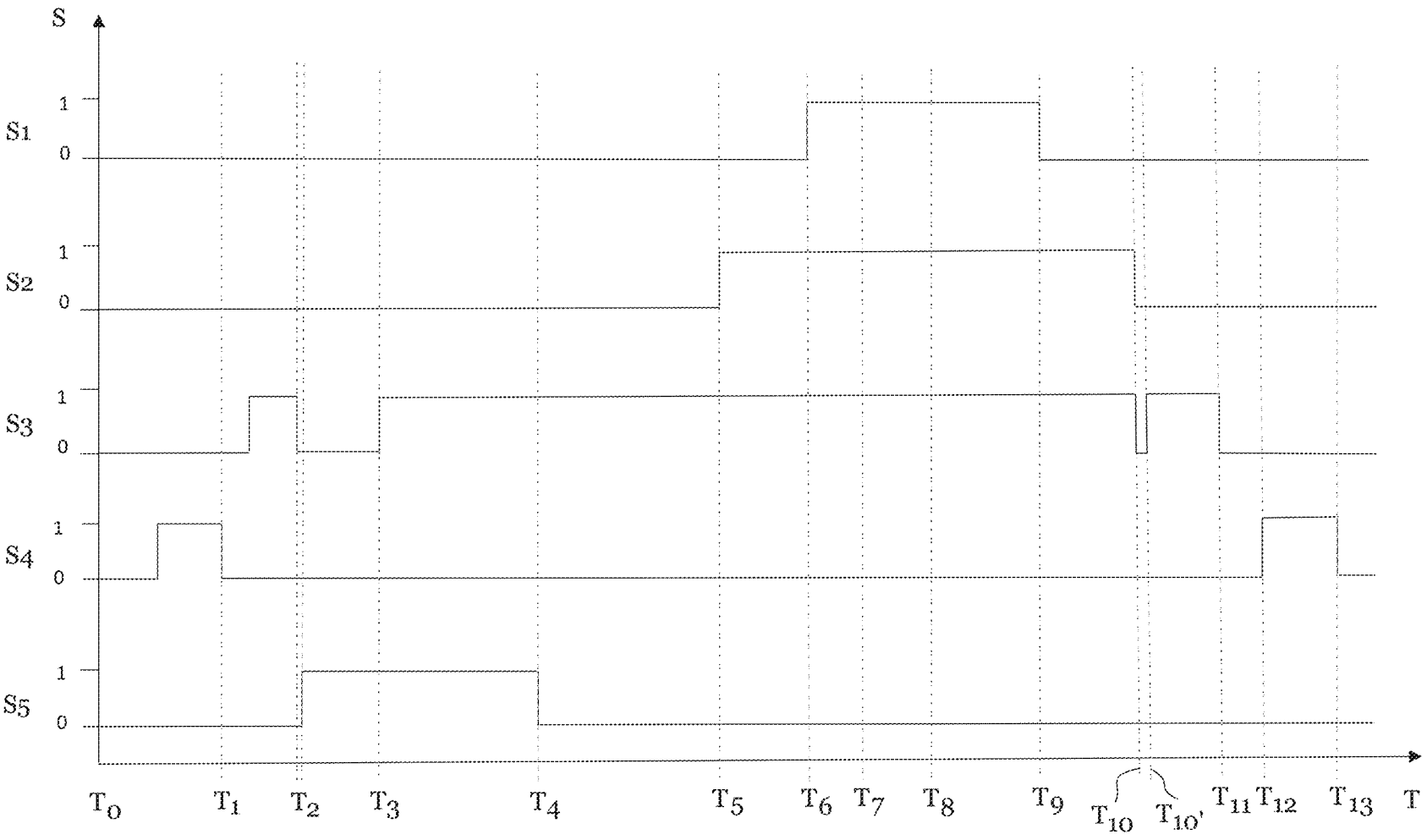

FIG. 12 shows signal traces for a method for controlling drives according to an exemplary embodiment of the disclosure.

Figure 13:
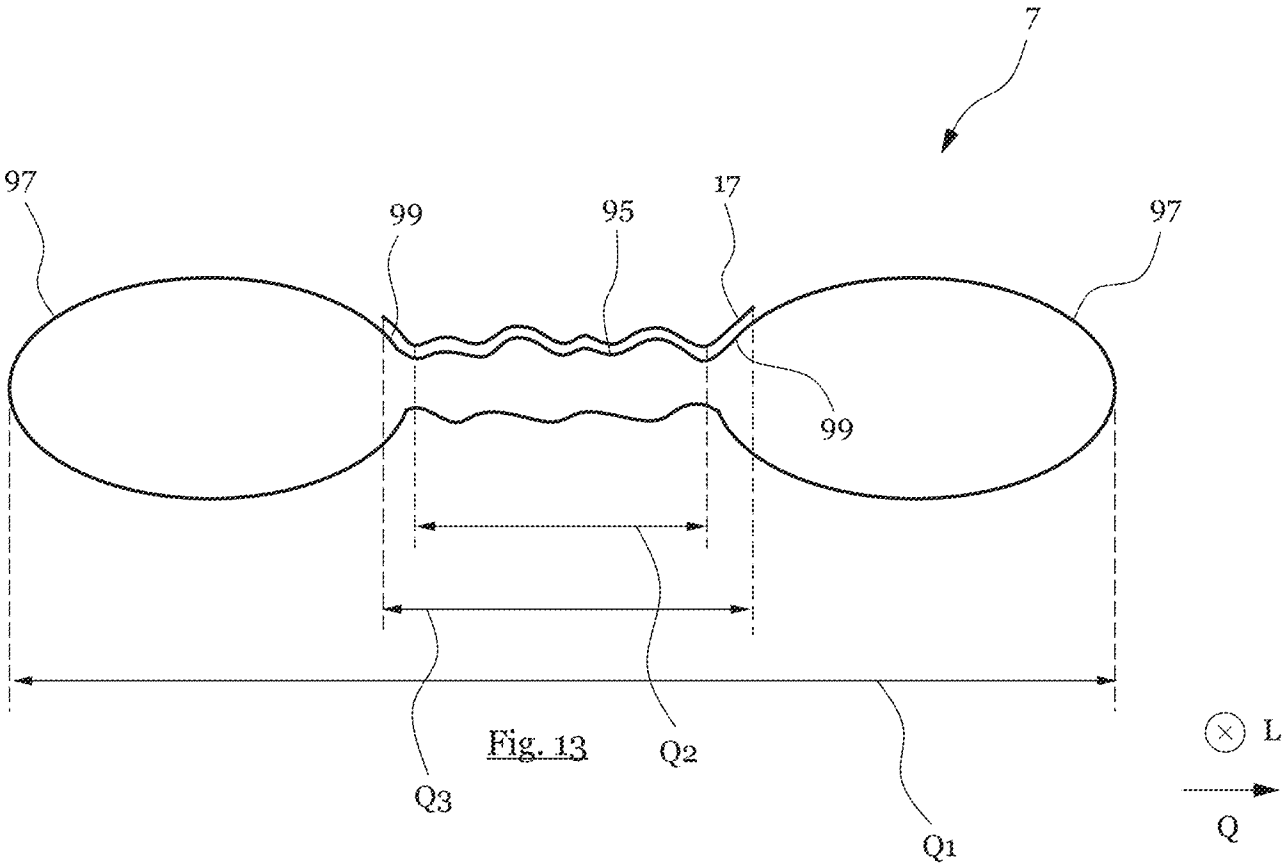

FIG. 13 is a schematic cross-sectional view of a strand of dunnage material according to an exemplary embodiment of the disclosure.

FIG. 14.1 is a schematic representation of a linear drive with guide and carriage before the tape head is brought to the outer end layer, according to an exemplary embodiment of the disclosure.

FIG. 14.2 is a schematic representation of the linear drive from FIG. 14.1, in which the contact of the adhesive tape head with the outer end layer is indicated, according to an exemplary embodiment of the disclosure.

FIG. 14.3 is a schematic representation of the linear drive of FIG. 14.2, where the carriage is moved further relative to the tape head, according to an exemplary embodiment of the disclosure.

Figure 15:
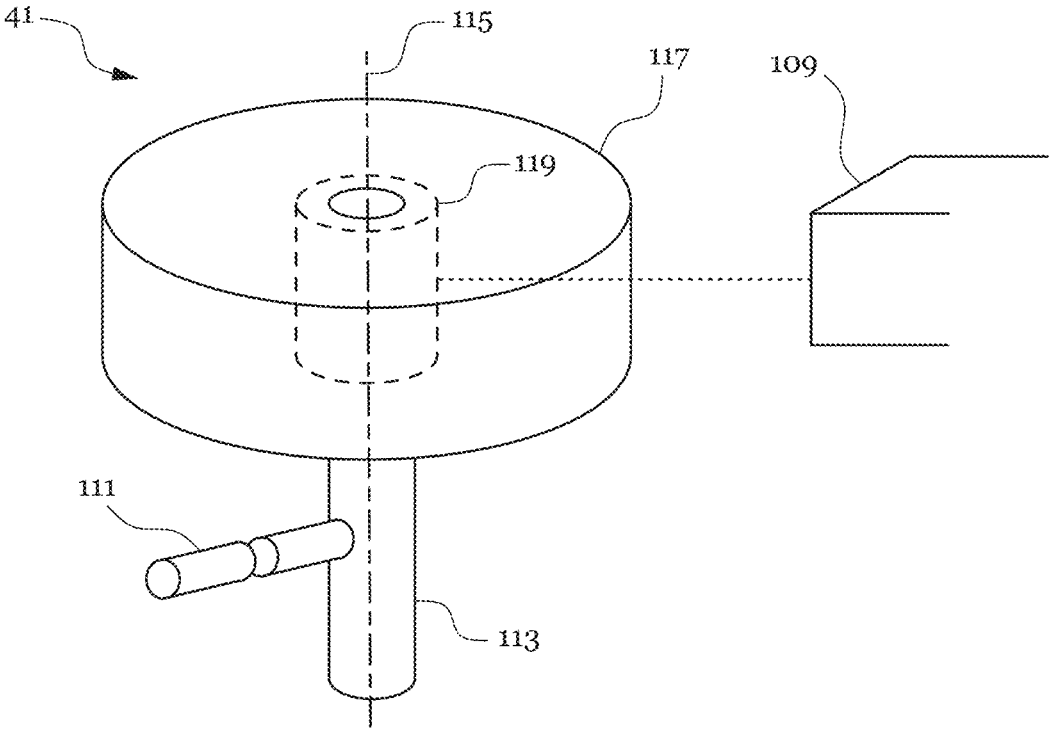

FIG. 15 is a schematic representation of tape monitoring devices, according to exemplary embodiments of the disclosure.

Figure 16:
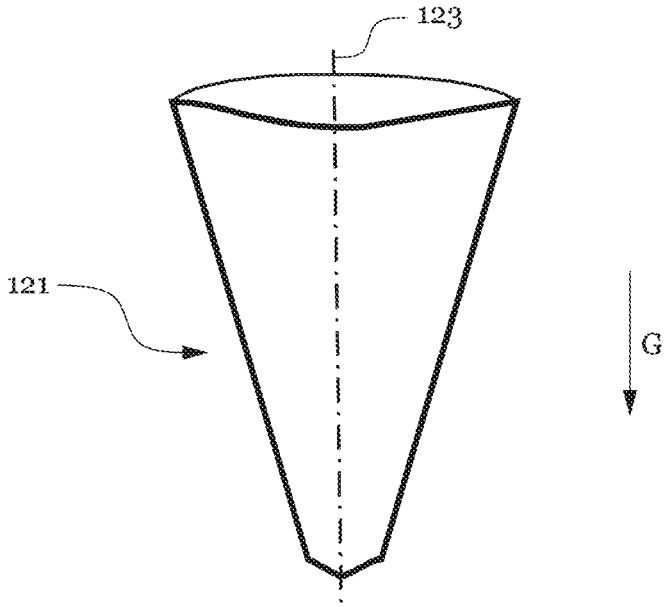

FIG. 16 is a schematic representation of a strand diverter according to an exemplary embodiment of the disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure. The connections shown in the figures between functional units or other elements can also be implemented as indirect connections, wherein a connection can be wireless or wired. Functional units can be implemented as hardware, software or a combination of hardware and software.

An object of the disclosure is to overcome the disadvantages of the prior art, in particular to provide a device and a method for processing a strand of dunnage material, in particular to form a coil of dunnage material, wherein the processing time and preferably the adhesive tape requirement are to be reduced and/or the development and maintenance effort for the device is to be reduced. Furthermore, another object of the present disclosure is to provide a coil of dunnage material which includes a reduced adhesive tape requirement with the same or increased dimensional stability.

The first aspect of the present disclosure relates to a device for processing a strand of dunnage material, in particular to a coil of dunnage material, made by a dunnage forming machine from a web-shaped starting material, in particular a roll or a leporello stack, for example of paper.

The dunnage material strand is made in particular from recycled paper. Recycled paper in particular refers to paper materials with a low proportion (less than 50%) of fresh fiber-containing paper material. In particular, paper materials containing 70% to 100% recycled paper are preferred. The recycled paper in the sense of the present disclosure is intended to be paper material that can have a tensile strength index along the machine direction of at most 90 Nm/g, preferably a tensile strength of 15 Nm/g to 60 Nm/g, and a tensile strength index across the machine direction of at most 60 Nm/g, preferably a tensile strength of 5 Nm/g to 40 Nm/g. A DIN EN ISO 1924-2 or DIN EN ISO 1924-3 standard can be used to determine the tensile strength or tensile strength index. In addition, or alternatively, a recycled paper property or recovered paper property can be characterized by the so-called bursting resistance. A material in this sense is recycled paper with a burst index of at most 3.0 kPa*m^2/g, preferably with a burst index of 0.8 kPa*m^2/g to 2.5 kPa*m^2/g. The DIN EN ISO 2758 standard is used to determine the bursting index. Furthermore, the packaging material includes a basis weight of, in particular, 40 g/m^2 to max. 140 g/m^2. According to the disclosure, the starting packaging material can be in the form of a material web roll or a zigzag-folded packaging material stack, which is also referred to as a fanfold stack.

The strand of dunnage material is produced in particular in such a way that an embossed deformation zone, in particular a wavy one, is formed centrally along the strand of dunnage material by the dunnage forming machine and is bounded laterally by two, in particular essentially uniform, bead ends. A dunnage forming machine for producing dunnage material strands from a web-shaped starting material is shown in EP 3159291 B1. In addition, a large number of cushion-forming machines are described in the prior art, which is why the specific design of these will not be discussed further below.

Processing the strand of dunnage material means in particular processing it to form a coil of dunnage material. In this context, a coil of dunnage material can on the one hand be a packaging material means, such as a dunnage material spiral or a dunnage material helix, but on the other hand also form a casing of an object to be cushioned. Here, for example, the processing may involve wrapping the strand of dunnage material around an article to be cushioned. In this regard, the resulting coil of dunnage material may, for example, extend spirally around the article to be cushioned, with the dunnage material layers moving away from the article in a radial direction as the number of layers increases. Alternatively, the coil of dunnage material may extend helically along a longitudinal axis of an article to be cushioned, wherein the radial spacing of the winding layers relative to the longitudinal axis of the article remains constant in the radial direction, in particular. Further, the coil of dunnage material may in particular be a combination of a dunnage material spiral and a dunnage material helix having winding layers adjoining each other both in the radial direction and in the longitudinal direction. In an exemplary embodiment, the dunnage material strand is processed into a coil of dunnage material separate from the articles to be cushioned, such as a dunnage material spiral or a dunnage material helix or a combination of both variants, whereby the dunnage material spiral is particularly preferred.

In accordance with the first aspect of the present disclosure, the device comprises a winding device for winding the strand of dunnage material about a winding center. It should be understood that winding center does not necessarily refer to a structural core around which the strand of dunnage material is wound. Rather, the winding center may merely describe a geometric position, in particular a winding axis, around which the strand of dunnage material is wound. In particular, the winding center does not necessarily have to be stationary. Rather, the winding center can assume different positions during the winding process. Such wrapping devices without structural design of the wrapping center are known, for example, from agriculture in the form of round balers for wrapping a round bale of straw. Such round balers wrap straw into a round bale by means of rollers arranged circumferentially around a wrapping center without requiring a structurally designed wrapping center. A wrapping device operating according to this principle for processing a strand of dunnage material into a wrapping of dunnage material is known from DE 10 2017 113 532 A1, the disclosure content of which concerning the wrapping device without a structurally designed wrapping center is included in the disclosure content of the present description. It is conceivable to use a similar winding device for realizing the present disclosure. For example, an arrangement of belts and/or rollers at least partially surrounding the winding center could be used to wind the strand of dunnage material around the winding center.

However, in an exemplary embodiment, a winding device with at least two or exactly two deflectors, in particular prongs, may be used, between which the strand of dunnage material, in particular one strand end of the strand of dunnage material, is conveyed. In an exemplary embodiment, the winding center is located in the middle of a line connecting the two deflectors. In an exemplary embodiment, the deflectors are rigidly connected to each other, in particular in the form of a reel, and/or are immovably fixed with respect to each other. In an exemplary embodiment, the deflectors are rotated about the winding center, in particular about a winding axis, for winding the strand of dunnage material, the winding axis extending through the winding center. In an exemplary embodiment, the winding axis extends in the vertical direction.

In accordance with the first aspect of the present disclosure, the device comprises an adhesive tape dispensing device directed with the winding device such that the adhesive tape dispensed by the adhesive tape dispensing device is only then applied to an outer end layer of the strand of dunnage material when the outer end layer is wound around the winding center. By this is to be understood in particular that the adhesive tape dispensing device is directed in such a way that the adhesive tape can be applied directly to the outer end layer in the wound state. In an exemplary embodiment, the adhesive tape dispensing device is directed for this purpose in such a way that the adhesive tape can be applied to the outer end layer wound around the winding center. In particular, the adhesive tape is applied to the outer end layer regardless of the radial extension of the coil of dunnage material. This means in particular that the adhesive tape dispensing device is designed in such a way that the adhesive tape can be applied at different radial extensions of the coil of dunnage material, in particular automatically. In particular, the application can take place at different radial extensions without having to calibrate the adhesive tape dispensing device for the change from one radial extension to another radial extension. In an exemplary embodiment, the application of the adhesive tape to the outer end layer independent of the radial extension of the coil of dunnage material is achieved by using the adhesive tape pivoting mechanism described further below, particularly preferably the spring-damped adhesive tape pivoting mechanism.

In an exemplary embodiment of the present disclosure, the adhesive tape dispensing device can also be immovable relative to the winding device. In such an embodiment, for example, the adhesive tape delivery device could be directed in such a way that the adhesive tape is not actively conveyed towards the outer end layer, but its adhesive surface is directed with the winding device in such a way that it is carried along by the outer end layer when the latter reaches a predetermined diameter.

Adhesive tape is understood to mean a carrier material, in particular in strip form, coated with pressure-sensitive adhesive. In an exemplary embodiment, another material with adhesive properties can be used as an alternative to the pressure-sensitive adhesive.

The term "outer end layer" refers in particular to the last, especially outermost, section of the strand of dunnage material which completely wraps around the winding center once. Completely wrapping means, in particular, winding for 360° around the winding center. By application is meant in particular the pressing of a free end of the adhesive tape against the outer end layer and preferably the subsequent winding for a predetermined angle around the winding center. In particular, the pad strand end of the outer end layer is overlapped at least once by the adhesive tape. Under the condition that the outer end layer must be wound around the winding center before the adhesive tape is applied, it is to be understood in particular that the outer end layer must be wound around the winding layer preceding it. However, it should be made clear that this does not mean that the outer end layer must make complete contact with the preceding winding layer. Rather, as a rule, the strand end will still protrude to a certain extent from the preceding winding layer when the adhesive tape is applied to the outer end layer. In particular, it is only by wrapping the adhesive tape around the winding center that the strand end will finally be pressed against the preceding winding layer. It is also not essential that the majority of the outer end layer is already wrapped around the winding center. Rather, it may be sufficient in particular that only a section of a few degrees, in particular at least 5°, 10°, 30°, 45° or 90°, of the outer end layer is wound around the winding center, as long as the adhesive tape is applied to this already wound section. In an exemplary embodiment, however, a section of at least 180° of the outer end layer is already wound around the winding center when the adhesive tape is applied to the already wound section.

In particular, the adhesive tape is only then applied to an outer end layer of the strand of dunnage material when the outer end layer has been wound around the winding center and the strand of dunnage material has been cut to length, in particular separated. When the strand of dunnage material is cut to length, the strand of dunnage material is separated in particular into a section on the winding device side and a section on the dunnage machine side. The dunnage material strand section on the winding device side in particular forms the outer end layer. After the outer end layer has been cut to length, it is wound in particular around the winding center. In particular, the adhesive tape is then applied to the outer end layer. In particular, the adhesive tape head does not move to the outer end layer until the outer end layer has been cut to length from the dunnage material strand and/or wound around the winding center.

By attaching the adhesive tape to the outer end layer already wound around the winding center, it is possible in particular to avoid adhesive tape overrun and thus to adjust, in particular reduce, the adhesive tape requirement as a function of the winding diameter to be achieved. Furthermore, the measure according to the disclosure provides degrees of freedom in the design of the device. For example, by applying the adhesive tape to the already wound outer end layer, the adhesive tape can be applied to the outer end layer at a vertical orientation so that the strand of dunnage material can also be wound about a vertical winding axis. In this way, in particular, the winding device can be designed in such a way that the weight force is used to remove the processed strand of upholstery material, in particular the winding of upholstery material, in particular the processed strand of upholstery material can be removed from the device by the weight force alone. This can further reduce the number of drives required, since, for example, an ejector mechanism, as used in the prior art, can be dispensed with. A further advantage is that the application of the adhesive tape to the already wound outer end layer enables the adhesive tape to be applied while the winding process continues. In particular, this allows processing times to be reduced compared to known devices.

In an exemplary embodiment, the adhesive tape dispensing device includes an adhesive tape head that is movably mounted relative to the winding device. The adhesive tape head is used in particular for applying the dispensed adhesive tape to the outer end layer. In an exemplary embodiment, the adhesive tape head is moved towards the outer end layer for applying the adhesive tape. In particular, a free end of the adhesive tape can be held by the adhesive tape head and applied to the outer end layer by guiding it to the outer end layer. The adhesive tape is then wound around the outer end layer, in particular via the winding device. In this process, further adhesive tape is obtained in particular from an adhesive tape supply, in particular unwound from an adhesive tape roll, and applied to the outer end layer in particular via the adhesive tape head. For this purpose, the adhesive tape supply can be designed, for example, as an adhesive tape roll which is mounted rotatably about its roll axis. The adhesive tape supply can be mounted either immovably or movably relative to the winding device. In particular, in an alternative embodiment, the adhesive tape supply can be decoupled from the movements of the adhesive tape head so that the adhesive tape head can be moved independently of the adhesive tape supply. However, in an exemplary embodiment, the adhesive tape supply may be attached to the adhesive tape head. In this way, in particular, the adhesive tape supply can be moved together with the adhesive tape head, so that the distance over which the adhesive tape must be guided between the adhesive tape supply and the outer end layer can be shortened and, in particular, kept constant. Alternatively, or additionally, the adhesive tape head may include a counter bearing, such as a deflection roller, for pressing the adhesive tape against the outer end layer. In an exemplary embodiment, the dispensed adhesive tape is fed to the outer end layer via the adhesive tape head and pressed against the outer end layer via the counter bearing. In this case, the counter bearing can be attached to the adhesive tape head so as to be rotatable, in particular about a vertical axis. In particular, the dispensed adhesive tape runs from the adhesive tape supply to the counter bearing and is applied to the outer end layer by the latter. In an exemplary embodiment, both the adhesive tape supply and the counter-bearing are attached to the adhesive tape head, wherein an adhesive tape roll may be provided as the adhesive tape supply and a deflection roll may be provided as the counter-bearing, wherein in particular the axes of rotation of the deflection roll and the adhesive tape roll run parallel to one another and/or are directed vertically. Alternatively, or additionally, the adhesive tape head is movably mounted, in particular spring-damped when applying adhesive tape to the outer end layer, in such a way that it follows a height profile of the circumferential course of the outer end layer.

In an exemplary embodiment, the adhesive tape dispensing device includes an adhesive tape pivoting mechanism, in particular a rotatably mounted pivoting arm, for pivoting the adhesive tape head to the outer end layer. In particular, the adhesive tape pivoting mechanism includes a rotatably mounted pivoting arm, which in particular is rotatably mounted at one end and is attached to the adhesive tape head at the other end. In an exemplary embodiment, the pivot arm is rotatably mounted about the side of the pivot arm facing away from the adhesive tape head. In particular, the adhesive tape head is brought to the outer end layer, in particular pivoted, by rotating the pivot arm about the rotatably mounted end. The adhesive tape pivoting mechanism may also have further pivoting arms that are rotatably mounted relative to each other. For example, a second swivel arm can be hinged to the rotatably mounted end of the first swivel arm and likewise be mounted with its other end rotatable relative to the winding device. In this way, in particular, the amplitude of movement of the adhesive tape head can be increased and the swivel movements of the adhesive tape head can be adapted to the winding diameter of the outer end layer by superimposing several swivel movements.

In an exemplary embodiment, the adhesive tape pivoting mechanism is spring-damped, in particular includes a gas pressure spring. In particular, this causes the adhesive tape head to wobble on the outer end layer, especially on a height profile in the radial direction along the circumferential course of the coil of dunnage material. The spring damping serves in particular to ensure that the adhesive tape swiveling mechanism adapts to the respective radial extension of the coil of dunnage material to be wound. The spring damping may be used to adapt to height profiles along the circumference of a coil of dunnage material and/or to different mean radial extensions of the outer end layer of different coil of dunnage materials. As a result, in particular when the adhesive tape is applied to the outer end layer, a contact pressure can be exerted on the adhesive tape, in particular via the counter bearing of the adhesive tape head. In particular, a single swivel arm of the adhesive tape swivel mechanism can be spring-damped or several swivel arms of the adhesive tape swivel mechanism can be spring-damped. The spring damping can in particular reduce the requirement for precision of the adhesive tape swiveling mechanism, since, if necessary, excessively high kinematic forces or excessively large movement amplitudes can be compensated for by the spring damping. In an exemplary embodiment, the swivel axis of the adhesive tape swivel mechanism is directed substantially in the vertical direction. In an exemplary embodiment, the swivel axis of the adhesive tape swivel mechanism, the swivel axis of the adhesive tape roll and/or the swivel axis of the counter bearing, in particular the deflection roller, are directed parallel to each other.

In an exemplary embodiment, the adhesive tape dispensing device includes a linear drive for guiding the adhesive tape head to the outer end layer. In an exemplary embodiment, the linear drive is coupled to the adhesive tape pivoting mechanism in such a way that a linear movement of the linear drive causes the adhesive tape head to pivot. In an exemplary embodiment, a linear drive is coupled for this purpose at a distance from the swivel axis of the adhesive tape swivel mechanism. In particular, several linear drives can be articulated to a swivel arm or distributed over several swivel arms, which in particular form the adhesive tape swivel mechanism. The use of linear drives to guide the adhesive tape head includes the advantage that, for example by using a gas spring, the drive and the spring damping can be implemented in particular in one component. Another advantage is that, compared to rotary drives, linear drives can also be realized at low cost and with low maintenance using pneumatic and hydraulic drives. In an exemplary embodiment, the drive axis of the linear actuator is directed essentially in the horizontal direction.

In an exemplary embodiment, the adhesive tape dispensing device includes a linear drive for guiding the adhesive tape head to the outer end layer, the linear drive having a guide, in particular a guide rail, and a carriage mounted in a translatory manner relative to the guide. In particular, the carriage is connected to the adhesive tape head in such a way that the adhesive tape head follows a movement of the carriage, in particular a translatory movement. Alternatively, or additionally, the drive axis of the linear drive is directed essentially in the horizontal direction.

In an exemplary embodiment, the adhesive tape head is mounted translationally relative to the carriage, in particular translationally in the same direction as the mounting of the carriage relative to the guide.

In an exemplary embodiment, the adhesive tape head and the carriage are coupled to each other via a suspension, in particular a spring, such as a spiral spring, in such a way that a translational relative movement between the carriage and the adhesive tape head causes a biasing force between the carriage and the adhesive tape head and/or causes a contact pressure of the adhesive tape head on the outer end layer. In particular, this can ensure secure adhesion of the adhesive tape to the outer end layer. In particular, secure adhesion can thereby be ensured even if a flat round section of a substantially elliptical outer end layer is opposite the adhesive tape head. In particular, the adhesive tape head exerts such a large contact force on the outer end layer that a sufficient counterforce is achieved to adhere the adhesive tape.

In particular, the spring pretension between the carriage and the adhesive tape head is matched to the deformation resistance of the outer end layer in the wound state in such a way that the spring pretension acts as damping so that the adhesive tape head follows a height profile of the outer end layer when the adhesive tape is applied.

In particular, the contact pressure force can act in the direction of the winding device, especially in the direction of the winding center. In particular, the direction of action of the contact pressure can be directed towards the winding center, especially towards the center of a connecting line between two deflectors, such as winding tines.

In an exemplary embodiment, the device includes a sensor, in particular an induction sensor, for detecting a relative movement, in particular a translational relative movement, between the adhesive tape head and the carriage. In particular, the sensor is coupled to a control of the linear drive in such a way that the control stops a movement of the linear drive when the sensor detects a predetermined relative movement between the adhesive tape head and the carriage.

In particular, the device comprises a control system programmed in such a way that the adhesive tape head is fed via the linear drive to the outer end layer cut to length from the strand of dunnage material and wound around the winding center. In particular, the adhesive tape head is advanced until contact is made between the adhesive tape head and the outer end layer. In particular, the tape is fed beyond the contact between the adhesive tape head and the outer end layer. In particular, the adhesive tape head is prevented from moving further by the outer end layer, while the carriage continues to move due to the translational bearing between the carriage and the adhesive tape head. This results in particular in the carriage compressing a spring of the suspension during further travel. In particular, further movement continues until the sensor, in particular an induction sensor, detects a predetermined relative movement between the tape head and the carriage, which is stored in the control system. In particular, the control system stops further movement of the adhesive tape head as soon as this predetermined relative movement is detected. The relative movement between the carriage and the adhesive tape head in particular causes the spring of the suspension to be tensioned. This results in particular in a contact pressure force acting from the adhesive tape head on the outer end layer. In particular, the contact pressure can be transmitted from the adhesive tape head to a counter bearing, such as a deflection roller for pressing the adhesive tape against the outer end layer.

One particular advantage of the linear drive described above is that production-related unevenness, in particular a not 100% circular outer end layer, can be compensated for by means of the built-up spring preload and/or contact pressure. In particular, a wobbling of the tape head along the height profile of the outer end layer can be ensured.

In particular, the linear drive is attached to a fixture housing of the device. In particular, the drive axis of the linear drive is directed parallel to the conveying direction of the strand of dunnage material between the strand access of the device, in particular the device housing, and the winding device.

In an exemplary embodiment, the device includes a separating device that is movably mounted relative to the winding device and includes a separating device, such as a blade, for separating the adhesive tape applied to the outer end layer. In an exemplary embodiment, the separating device is movably mounted in such a way that the adhesive tape can be separated directly at the wound outer end layer. During severing, the separator device moves in particular through the adhesive tape and preferably partially into the outer end layer. This means that the outer end layer in particular can be used as a counter surface for the severing process. Immediate separation at the outer end layer can in particular reduce or prevent adhesive tape tracking, which in particular still includes to be applied to the outer end layer. By severing the adhesive tape at the wound or wrapped outer end layer, it is to be understood that the severing takes place at a section of the outer end layer that is already wound around the winding center. By severing the adhesive tape at the wound outer end layer, it is not to be understood that the severing must occur at a section of adhesive tape that must be in contact with the outer end layer during the severing operation. Rather, in an exemplary embodiment, the severing device is configured such that the adhesive tape is tensioned during the severing operation. In an exemplary embodiment, the adhesive tape is tensioned during the severing operation in such a way that the adhesive tape section at which severing takes place is free of contact with the outside of the outer end layer during the severing operation. In this state, the adhesive tape section extends in particular linearly between the last end of the adhesive tape still in contact with the outer end layer and a spring element, such as the spring plate described further below. In an exemplary embodiment, the adhesive tape is affected by the pivotal movement of the severing device, as described further below. In an exemplary embodiment, the severing device is configured such that the tension exerted on the adhesive tape assumes its maximum value immediately before the adhesive tape is severed.

In an exemplary embodiment, the separating device includes a separating swivel mechanism for swiveling the separating device towards the outer end layer. In particular, the separator device is pivoted by the adhesive tape towards, or in particular partially into, the outer end layer. In an exemplary embodiment, the separating swivel mechanism is spring-damped, in particular with a gas pressure spring. In an exemplary embodiment, the swivel axis of the peel-off swivel mechanism is directed substantially in the vertical direction. In principle, the severing mechanism can be designed independently of the tape head. However, in an exemplary embodiment, the severing device may be coupled to the adhesive tape head, in particular to connect it firmly to the latter. In this way, in particular, the adhesive tape swivel mechanism can be used for simultaneously bringing the adhesive tape and the severing device to the outer end layer. In an exemplary embodiment, the peel-off pivoting mechanism is implemented by a pivotable mounting of the adhesive tape head. By pivotable mounting of the adhesive tape head it is to be understood in particular that the adhesive tape head is pivotably mounted relative to the pivot arm of the adhesive tape pivoting mechanism. In this context, in particular on the one hand the swivel arm of the adhesive tape swivel mechanism can be swivel-mounted in such a way that it can bring the adhesive tape head to the outer end layer by a rotary movement about its swivel axis and the adhesive tape head can subsequently be rotated with respect to the swivel arm as a result of the swivel-mounting with respect to the swivel arm. In an exemplary embodiment, the separator device is spaced from the swivel axis of the adhesive tape head in such a way that the rotary movement of the adhesive tape head causes the separator device to swivel towards the adhesive tape.

In an exemplary embodiment, the adhesive tape swivel mechanism and the cut-off swivel mechanism are coupled to each other via a link chain. In an exemplary embodiment, the link chain is formed by two swivel joints formed on the swivel arm of the adhesive tape swivel mechanism. By swivel joint is meant, in particular, the structural design of the rotatable bearing. In an exemplary embodiment, the first swivel joint may be attached to the end of the swivel arm facing away from the adhesive tape head and is used to implement the adhesive tape swivel mechanism, via which the adhesive tape head can be swiveled to the outer end layer. This serves in particular to apply the adhesive tape to the outer end layer. Once the adhesive tape head has been pivoted to the outer end layer, the adhesive tape can be wound around the outer end layer in particular by driving the winding device, in particular by rotating the outer end layer. In an exemplary embodiment, the second swivel joint may be formed at the end of the swivel arm facing the adhesive tape head, and in particular rotatably connects the swivel arm and the adhesive tape head to one another. As a result, the adhesive tape head, in particular after application of the adhesive tape, can be rotated relative to the swivel arm in such a way that a separator device attached to the swivel arm cuts through the adhesive tape. For this purpose, in an exemplary embodiment, the separator device is arranged at a distance from the second pivot joint, so that the rotation of the adhesive tape head causes a pivoting movement of the severing device, in particular of a separator device attached to the adhesive tape head. The second swivel joint is thereby designed in particular to implement the peel-off swivel mechanism.

In an exemplary embodiment, the separating device includes a linear drive for guiding the separating device to the outer end layer, in particular through the adhesive tape to the outer end layer. In this case, in an exemplary embodiment, the linear drive is coupled to the separating swivel mechanism in such a way that a linear movement of the linear drive causes a swivel movement of the separating device. In an exemplary embodiment, the drive axis of the linear actuator is oriented substantially in the horizontal direction. In an exemplary embodiment, the linear drive of the severing swivel mechanism may be coupled to the adhesive tape head, in particular to couple it to the adhesive tape head at a distance from the rotatable bearing of the severing swivel mechanism. Since the adhesive tape head is located at the outer end layer, in particular for adhesive tape application, this means that only a small stroke movement is required to guide the separator device through the adhesive tape to the outer end layer, thereby severing the adhesive tape. In an exemplary embodiment, the separator device is fixed and immovable to the adhesive tape head and projects beyond the adhesive tape head, particularly in the horizontal direction, in such a way that the rotary movement of the adhesive tape head caused by the linear drive causes a pivoting movement and penetration of the separator device into the adhesive tape.

In an exemplary embodiment, the severing device includes a spring plate that is arranged relative to the separator device in such a way that it exerts a spring force on the adhesive tape when the tape is severed, in particular tensioning it.

In an exemplary embodiment, the device includes a control system by means of which the adhesive tape dispensing device, the winding device and/or the severing device are controlled.

In an exemplary embodiment, the device includes a device housing for preventing unintentional interference with the winding device and/or the adhesive tape dispensing device, which includes a strand access through which the strand of dunnage material can be transferred to the device. The device housing can in particular reduce the risk of injury to a person operating the device. For this purpose, in an exemplary embodiment, the device may be configured such that an operator cannot possibly reach into it during operation of the device. For this purpose, the device housing can, for example, be designed as a particularly complete enclosure of the winding device and the adhesive tape dispensing device, which, in particular, includes the strand access as the only possibility of intervention. In an exemplary embodiment, the device housing includes at least one closing mechanism, such as a roller shutter, with which access to the winding device can be prevented during processing of the strand of dunnage material and can be released after processing. For example, a closing mechanism may be provided that can close and release a dispensing opening for dispensing the processed strand of dunnage material, particularly the strand of coil of dunnage material. The discharge opening of the device may be arranged below the winding device, so that the processed strand of dunnage material, in particular the coil of dunnage material, can be removed from the device using the force of gravity, in particular can be deposited on a storage table for storage or can be delivered to a storage channel, a chute or the like.

In an exemplary embodiment, the device comprises a position detection device which is designed to detect whether the strand of dunnage material is in engagement with the winding device, whether an unintentional engagement occurs during the processing of the strand of dunnage material into the winding device and/or into the adhesive tape dispensing device, and/or whether an independent detachment of the processed strand of dunnage material from the winding device occurs, in particular by gravity. For this purpose, in particular, a sensor for position detection at the strand access and a sensor for position detection at the winding device can be provided. In an exemplary embodiment, the sensors can be coupled to a controller that controls the winding device and the tape dispensing device. This allows, for example, processing to be initiated by the controller starting the winding operation when a signal is received from both sensors indicating that the strand of dunnage material includes entered the device via the strand access and is in engagement with the winding device. Further, a safety mechanism can be integrated via the sensors to shut down the device once the sensors detect engagement with the device. In an exemplary embodiment, the sensors are directed and/or the control system is designed in such a way that the application of the adhesive tape and the winding of the strand of dunnage material is not interpreted as an engagement with the device.

In particular, the device may include at least one strand diverter for diverting the strand of dunnage material between a strand access and the winding device. In particular, the strand diverter may be disposed between the strand access and the winding center. In particular, the strand diverter shifts the deflection of the strand of dunnage material from the outlet of the dunnage forming machine toward the winding device. In particular, this can prevent sharp-edged grinding on one side of the outlet opening. In particular, this can reduce the risk of tearing off the strand of dunnage material. This is particularly important in the case of large coil of dunnage materials, since here there is a greater deflection of the dunnage material strand.

In particular, the strand diverter can be rotatably mounted about an axis of rotation extending in particular in the direction of gravity. In particular, the axis of rotation of the strand deflector can extend parallel to the axis of rotation of the winding device. In particular, this enables the strand deflector to support an orientation, in particular an erection, of the strand of dunnage material in an orientation intended for the winding device.

In particular, the strand deflector can have a cross-sectional area that tapers, especially in the direction of gravity, and in particular be of conical design. In particular, the strand deflector can be designed as a deflection roller tapering along the axis of rotation, especially in the direction of gravity.

In an exemplary embodiment, the device comprises an adhesive tape monitoring device having a sensor, such as an inductive sensor or an optical sensor, for monitoring the application of the adhesive tape to the outer end layer. In particular, the sensor is adapted to detect a movement, especially a rotational movement, of an adhesive tape supply providing the adhesive tape. In particular, the rotational movement can be detected via an optical sensor directed at the adhesive tape supply, such as an adhesive tape roll. Alternatively, or additionally, the rotational movement can be detected via an inductive sensor. In particular, the inductive sensor can detect the rotary motion of a shaft that rotatably accommodates the adhesive tape supply.

Alternatively, or additionally, the device may comprise an adhesive tape monitoring device having an inductive sensor for monitoring the adhesive tape consumption. In particular, the inductive sensor may be designed to detect the rotation of an adhesive tape supply providing the adhesive tape. In particular, the detected rotation can be converted into adhesive tape consumption by a controller of the adhesive tape monitoring device. In particular, the controller may be configured to count the number of detected rotations of the adhesive tape supply. In particular, the control system can be designed to calculate the adhesive tape consumption using the number of detected revolutions. For this purpose, the number of revolutions after an adhesive tape roll has been used up can be stored in the control system, for example. In this example, the predetermined adhesive tape consumption could be specified as a number of revolutions, for example. Alternatively, the predetermined tape consumption could be specified as a tape length. For this purpose, the controller could be designed to convert the number of revolutions into a tape length.

In particular, the control system can be designed to trigger an alarm signal when a predetermined adhesive tape consumption is reached. The alarm signal may be, for example, an audible signal and/or a visual signal. In particular, the device may include an alarm light via which a visual alarm signal, such as a red glow, is emitted. In particular, the visual alarm signal may be visible to a person operating the device.

Alternatively, or additionally, the device may in particular comprise an adhesive tape monitoring device comprising an optical sensor for monitoring the adhesive tape consumption. The optical sensor may be designed to detect the diameter of an adhesive tape supply providing the adhesive tape. In particular, the optical sensor may be directed with the axis of rotation of an adhesive tape roll, wherein the sensor is directed in particular in the radial direction.

In particular, the detected diameter can be monitored by a control of the adhesive tape monitoring device, especially wherein the control is designed to trigger an alarm signal if the diameter falls below a predetermined minimum diameter. In particular, the control of the adhesive tape monitoring device is designed to measure the diameter of the adhesive tape roll via the distance between the outer end layer of the adhesive tape roll and the optical sensor.

In an exemplary embodiment, the axis of rotation of the winding device is directed essentially in the vertical direction. In an exemplary embodiment, the winding device is designed as a reel with two deflectors, such as tines, each having an end coupled to a rotary drive and a free end, the free end of the deflectors preferably projecting in the direction of gravity. In this way, in particular the gravitational force can be used to remove the processed strand of dunnage material, in particular the coil of dunnage material. In an exemplary embodiment, the winding device is driven by a rotary drive, in particular by a rotary motor.

Another aspect of the disclosure, which is particularly combinable with the other aspects of the disclosure, relates to a device and a method for processing a strand of dunnage material, in particular to a coil of dunnage material, made by a dunnage conversion machine from a web-shaped starting material, in particular a roll or a leporello stack, for example of paper. The device comprises a winding device for winding the strand of dunnage material around a winding center, and an adhesive tape dispensing device for applying adhesive tape to the strand of dunnage material. In the process, the strand of dunnage material is wound around a winding center by a winding device and an adhesive tape is applied to the strand of dunnage material by means of an adhesive tape dispensing device. According to the device and method of the disclosure, the adhesive tape dispensing device and the winding device are arranged to be movable relative to one another, in particular in such a way that they can move toward one another. This relative mobility between the winding device, in particular the in particular stationary winding drum, and the adhesive tape dispensing device serves to bring the adhesive tape dispensing device and the strand of dunnage material, in particular the outer end layer wound in particular last, into pressure contact so that the adhesive tape can be applied, in particular glued, to the strand of dunnage material.

The relative movability to each other is realized in particular by a movable adhesive tape dispensing device and/or by a movable winding device.

In one embodiment, the relative mobility is realized by a movable adhesive tape dispensing device. The movable adhesive tape dispensing device is realized in particular by the adhesive tape pivoting mechanism described above and/or by the linear drive described above.

Alternatively, or in addition to the movable adhesive tape dispenser, the relative movability is realized in particular by a movable winding device. In particular, the movable winding device is realized by a movable guide, in particular movable bearing, of the winding device.

A second aspect of the present disclosure relates to a method of processing a strand of dunnage material produced by a dunnage forming machine from a web-shaped starting material, in particular a roll or a leporello stack, for example of paper, wherein the strand of dunnage material is wound around a winding center and an adhesive tape is applied to an outer end layer of the strand of dunnage material only after the outer end layer has been wound around the winding center. In an exemplary embodiment, the method is carried out using the device described above.

The device according to the disclosure can in particular be structured in such a way that it can carry out the method according to the disclosure. In particular, the method according to the disclosure can be defined in such a way that it can run according to the operation of the device according to the disclosure.

In an exemplary embodiment, the adhesive tape is brought to the outer end layer before it is applied to the outer end layer. The adhesive tape is brought to the outer end layer in particular by means of a pivoting movement and/or by means of a linear movement, which in particular causes a pivoting movement of the adhesive tape towards the outer end layer. Alternatively, or additionally, the pivoting movement and/or the linear movement is affected by means of a spring-damped drive, in particular by means of a spring-damped linear drive. Furthermore, in an exemplary embodiment, the adhesive tape may be guided to the outer end layer together with an adhesive tape supply, such as an adhesive tape roll.

In an exemplary embodiment, the dunnage material strand is processed into a dunnage material coil.

In an exemplary embodiment, the adhesive tape is applied to the outer end layer via an adhesive tape head, which is moved towards the outer end layer by a linear movement before being applied to the outer end layer. In an exemplary embodiment, the adhesive tape head is brought to the outer end layer via a carriage of a linear drive, the linear movement of the adhesive tape head being slowed down, in particular paused or stopped, by the contact with the outer end layer, while the carriage continues the linear movement, so that a relative movement is produced between the carriage and the adhesive tape head.

In an exemplary embodiment, the relative movement between the linear movement of the adhesive tape head and the carriage is detected, in particular measured by means of a sensor, such as an induction sensor. In particular, the linear movement of the carriage is interrupted, in particular interrupted by a controller, as soon as a predetermined relative movement, in particular a relative movement stored in a controller, between the adhesive tape head and the carriage is detected.

In an exemplary embodiment, the relative movement between the adhesive tape head and the carriage causes a spring tension between the carriage and the adhesive tape head and/or a contact force of the adhesive tape head on the outer end layer. In particular, the spring tension between the carriage and the adhesive tape head and/or the contact force of the adhesive tape head on the outer end layer acts in such a way that the adhesive tape head follows a height profile of the circumferential course of the outer end layer.

In an exemplary embodiment, before the adhesive tape is applied, the radial extent of the outer end layer, in particular at the position to which the adhesive tape is fed, is detected in order to adapt a feed movement of the adhesive tape to the outer end layer to the radial extent of the outer end layer. Alternatively, or additionally, the circumferential position of the dunnage or cushion strand end is detected before the adhesive tape is applied, in order to bring the adhesive tape in close proximity to the cushion strand end, in particular to reduce the amount of adhesive tape required for fastening the cushion strand end. The cushion strand end is to be understood in particular as the end section of the outer end layer. The cushion strand end is fastened in particular to the outer end layer itself. In particular, the cushion strand end is adhered with the adhesive tape to the beginning of the outer end layer wound around the winding center.

In an exemplary embodiment, the radial extension of the outer end layer is detected continuously or sectionally during application of the adhesive tape in order to adapt the adhesive tape position and/or the force with which the adhesive tape is pressed against the outer end layer to the radial extension of the outer end layer. In an exemplary embodiment, the force with which the adhesive tape is pressed against the outer end layer is generated via a linear drive and/or via a gas spring.

In an exemplary embodiment, the adhesive tape attached to the outer end layer is severed. In particular, the adhesive tape is separated after it has been substantially completely wound onto the outer end layer. In this context, "substantially" means that the application of the adhesive tape to the outer end layer is already complete, but a small adhesive tape end section of a few centimeters can still protrude from the outer end layer or can be partially pulled off the outer end layer in the course of the separation movement. In an exemplary embodiment, the adhesive tape is severed at the outer end layer. Alternatively, or additionally, the severing may take place by means of a pivoting movement and/or by means of a linear movement of a separator device, such as a cutting edge. In an exemplary embodiment, the separation is affected by a pivoting movement of the separating device, which is affected by a linear movement of a drive, in particular via a separating pivoting mechanism.

In an exemplary embodiment, the adhesive tape is separated by moving a separator device towards the particularly smooth surface of the adhesive tape opposite the adhesive surface. This includes the particular effect of preventing the adhesive tape from adhering to the separator device as a result of the severing movement.

In an exemplary embodiment, the adhesive tape is tensioned before it is cut. In particular, the adhesive tape is tensioned around the outer end layer. In particular, the tension can be tightened by pressing the adhesive tape against the outer end layer. Alternatively, or additionally, the tensioning of the adhesive tape can be affected by the pivoting movement of the severing device, in particular of the adhesive tape head. In this case, in particular as a result of the pivoting movement, a spring plate can come into engagement with the adhesive tape and exert a tensile force on the adhesive tape, so that the severing process is facilitated. Alternatively, or additionally, the adhesive tape can be tensioned around the outer end layer by slowing down, in particular blocking, the adhesive tape delivery so that the adhesive tape is tensioned around the outer end layer as a result of a rotation of the outer end layer by a certain angular range.

In an exemplary embodiment, the processed dunnage material strand, in particular the coil of dunnage material, is accelerated in the winding direction and/or in the direction opposite to the winding direction, in particular after the adhesive tape has been applied and cut off. This acceleration serves in particular to release the processed strand of dunnage material from a device with which it was processed. In particular, in an embodiment in which winding takes place about a vertical axis, this means that an additional ejector drive can be completely dispensed with.

In an exemplary embodiment, the adhesive tape extends substantially in a vertical direction when applied to the outer end layer. In an exemplary embodiment, the adhesive tape may be wrapped by at least 1080°, 720°, 540°, 360°, 180°, 90°, 45° or 15°. In particular, when there are high requirements for the dimensional stability of the processed strand of dunnage material, it is advisable to wind the adhesive tape around a larger angular range, such as a winding range between 360° and 1080°, in particular between 380° and 810°. In contrast, a smaller angular range, in particular between 15° and 180°, especially preferably between 45° and 90°, can also be selected if the requirements for dimensional stability are smaller. In this embodiment, the position of the dunnage material strand end is determined before the adhesive tape is applied to the outer end layer. This makes it possible in particular to reduce the amount of adhesive tape required.

In an exemplary embodiment, winding takes place about a winding axis directed essentially in the vertical direction.

In an exemplary embodiment, the process is regulated by a control system. In particular, the control system controls or regulates the transfer of the strand of upholstery material to a device for processing the strand of upholstery material. This means in particular an introduction of the strand of dunnage material via a strand access into a device, which is limited by a device housing. In this context, for example, a position detection of the strand of dunnage material can take place at the strand access, whereby the control system receives feedback as to whether or not a strand of dunnage material is located in the strand access. Transferring can further additionally comprise conveying the strand of dunnage material towards the winding center, in particular between two deflectors of the winding device. Transferring may further comprise, in particular, detecting the position of the strand of dunnage material at the winding center, wherein the controller receives feedback as to whether or not a strand of dunnage material is located at the winding center. In particular, the control system may be configured to initiate winding of the strand of dunnage material around the winding center as a function of the sequence of these two feedback signals. In particular, the control system can control and/or regulate the application of the adhesive tape to the outer end layer. In particular, this may include feeding the adhesive tape to the outer end layer and rotating the outer end layer about the winding center to wrap the adhesive tape around the outer end layer. Further, the severing of the adhesive tape applied to the outer end layer from an adhesive tape dispensing device may be controlled and/or regulated by the controller. In particular, the severing of the adhesive tape may be initiated by the severing of the strand of dunnage material from the dunnage conversion machine, which in turn may be controlled and/or regulated by the controller.

A third aspect of the present disclosure relates to a coil of dunnage material comprising a wound dunnage material strand. The strand of dunnage material is produced by a dunnage forming machine from a web-shaped starting material, in particular a roll or a leporello stack, for example of paper, in particular recycled paper, in such a way that centrally, along the strand of dunnage material, an embossed deformation zone, in particular wavy, is formed by the dunnage forming machine, which deformation zone is laterally bounded by two, in particular substantially uniform, bead edges. Further, the coil of dunnage material comprises an adhesive tape applied to an outer end layer of the coil of dunnage material and extending in the longitudinal direction of the dunnage material strand for securing the outer end layer to the coil of dunnage material. According to the third aspect of the present disclosure, the adhesive tape is thereby arranged and dimensioned such that it contact-adhesively covers the deformation zone at least partially and a transition region to one bead edge or to both bead edges of at least two millimeters. A particular advantage of the measure according to the disclosure is that an additional contact adhesive area is created.

It is particularly advantageous that the bead edges are generally less wavy than the deformation zone, so that with the same adhesive tape area, a larger adhesive contact area can be achieved between the adhesive tape and the strand of dunnage material at the transition area to the bead edges than in the wavy transition area, where the adhesive tape only comes into adhesive contact with the deformation zone in sections, depending on the waviness of the latter. By using the transition area to one or both bead edges for adhesive contact, the force required to apply the adhesive tape to the outer layer can be reduced in particular, since adhesive contact with the bead edges can be made more easily due to the reduced waviness. Furthermore, such a coil of dunnage material exhibits increased dimensional stability due to the additional adhesive contact at the transition area.

The coil of dunnage material according to the disclosure can in particular be structured according to the method according to the disclosure and/or the device according to the disclosure. In particular, the process according to the disclosure can be carried out in such a way that it is suitable for producing the coil of dunnage material according to the disclosure and/or can be carried out using the device according to the disclosure. Furthermore, the device according to the disclosure can in particular be structured in such a way that the process according to the disclosure can be carried out and/or the coil of dunnage material according to the disclosure can be produced.

In an exemplary embodiment, the coil of dunnage material is produced using the previously described device or process.

In an exemplary embodiment, the adhesive tape covers at least one sixth and/or three quarters of the transverse extent of the strand of dunnage material. It has been found that covering at least a quarter and at most half, in particular about a third, of the transverse extent of the strand of dunnage material represents a good compromise between the greatest possible adhesive contact and the smallest possible adhesive demand by adjusting the adhesive tape width.

In an exemplary embodiment, the adhesive tape covers the entire transverse extent of the deformation zone of the strand of dunnage material and at least one fiftieth, in particular at least one thirtieth, one twentieth, one tenth, one fifth or one third of the transverse extent of at least one, preferably both, beaded edges of the strand of dunnage material. In an exemplary embodiment, the adhesive tape is applied centrally to the strand of dunnage material so that both bead edges are evenly covered with the adhesive tape.

In an exemplary embodiment, the tape is wrapped at least 15°, 45°, 90°, 180°, 360°, 540°, 720° or 1080° around the outer end layer.

The same or similar reference signs are used below for the same or similar components. Hereinbelow, schematic representations of a device for processing a strand of dunnage material are provided with the reference numeral 1. Schematic representations of a winding device are provided with the reference numeral 3. Schematic representations of an adhesive tape dispensing device are provided with reference numeral 5. Schematic representations of a strand of dunnage material are provided with reference numeral 7.

Figure 1:
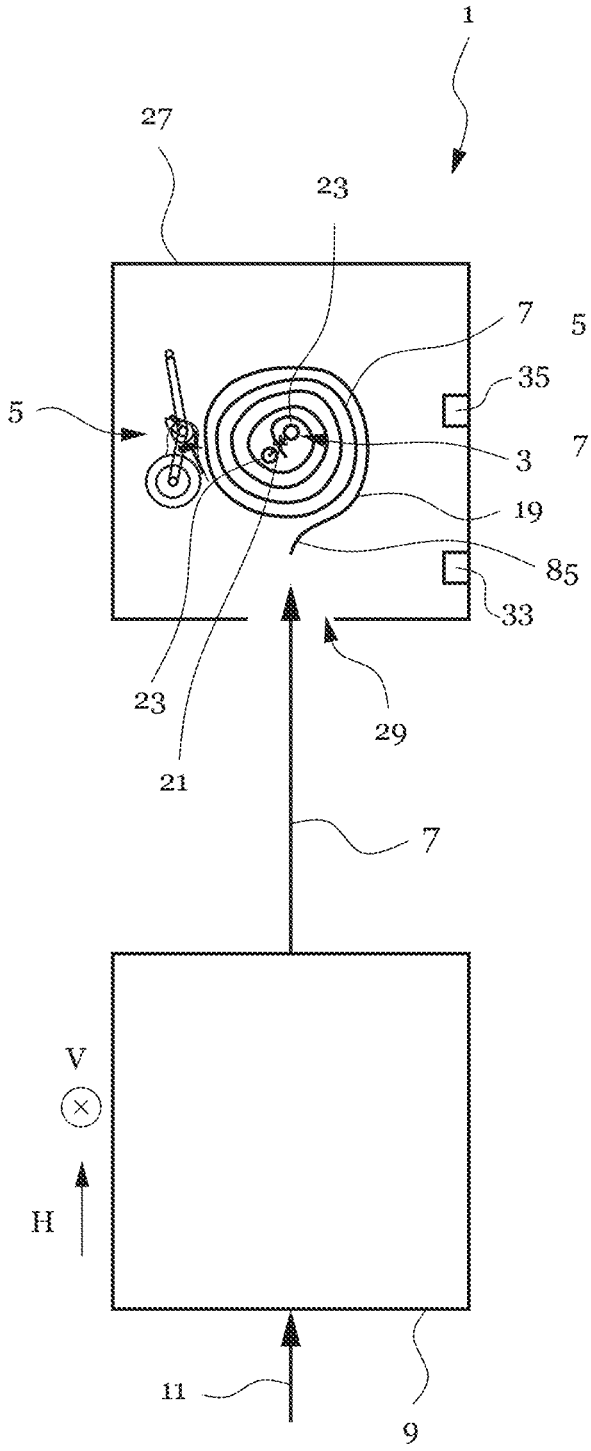
FIG. 1 is a top-view schematic representation of a device according to an exemplary embodiment of the disclosure with a dunnage forming machine.
Figure 2:
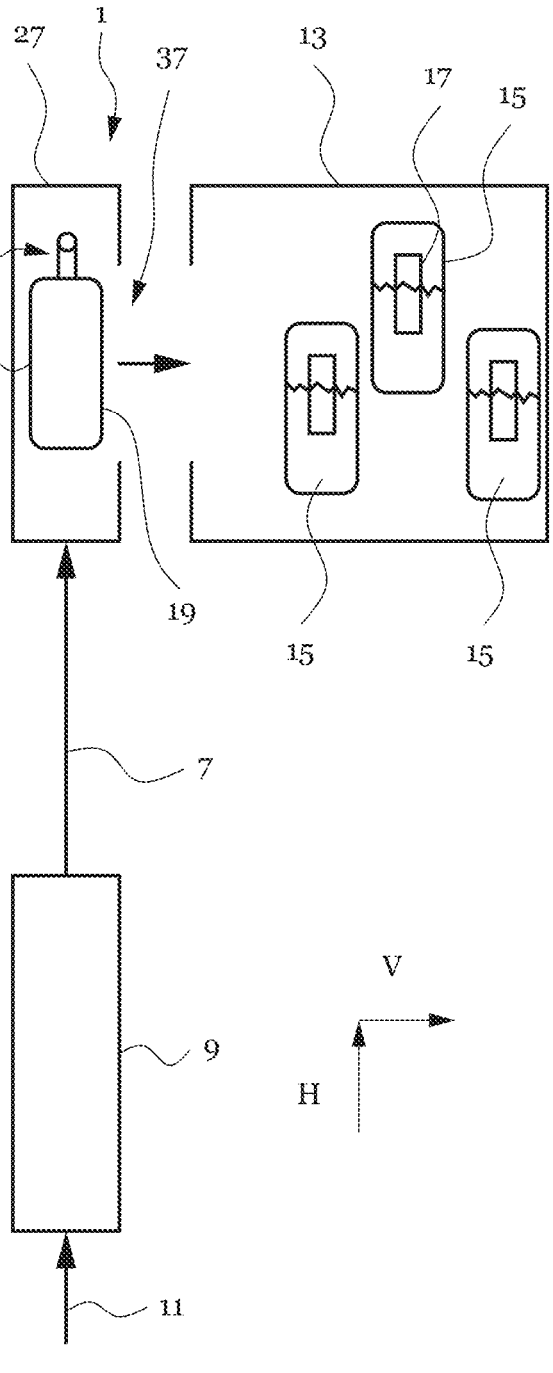
FIG. 2 is a side view of the device from FIG. 1, according to an exemplary embodiment of the disclosure.

FIG. 1 shows a schematic representation of a top view of a device 1 according to the disclosure and of a schematically indicated dunnage forming machine 9. As indicated by the lower arrow in FIG. 1, a strand of dunnage material 7 is produced in the dunnage forming machine from a web-shaped starting material 11, in particular a roll or a fanfold stack, for example of paper. FIG. 2 shows a side view of FIG. 1, in which a collecting container 13 is indicated, in which three processed dunnage material strands are indicated in the form of coil of dunnage materials. In the following, the reference numeral 15 is used for both processed dunnage material strands and coils of dunnage material. The winding device 3 is provided for winding the strand of dunnage material 7 around a winding center 21. As can be seen in particular in FIG. 1, the adhesive tape dispensing device 5 is directed with the winding device 7 in such a way that the adhesive tape 17 dispensed by the adhesive tape dispensing device is only then applied to an outer end layer 19 of the strand of dunnage material after the outer end layer 19 is wound around the winding center 21. As indicated in FIGS. 1 and 3 to 10, the winding device may be formed by two deflectors 23 between which, in particular, the winding center 21 lies. In an exemplary embodiment, the winding center 21 lies in the middle of a line 25 connecting the two deflectors 23.

In FIGS. 1 and 2, a device housing 27 for preventing unintentional engagement with the winding device 3 and/or the adhesive tape dispensing device 5 is schematically indicated. As can be seen in particular in FIG. 1, the device housing 27 includes a strand access 29 through which the strand of dunnage material 7 can be transferred to the device 1. In this context, transfer means in particular the introduction of the strand of dunnage material 7 into the device 1 via the strand access 29. Transferring can also include conveying the strand of dunnage material 7 in the direction of the winding center 21, in particular between two deflectors 23 of a winding device 3.

Furthermore, a position detection device may be provided to detect whether the dunnage material strand 7 is in engagement with the winding device 3 and/or whether an unintentional engagement occurs during the processing of the dunnage material strand 7 into the winding device 3 and/or into the adhesive tape dispensing device 5. In particular, the position detection device may comprise a sensor 33 for position detection at the strand access and a sensor 35 for position detection at the winding device 3 and/or sensors 33, 35 for detecting a release of the coil of dunnage material. In an exemplary embodiment, the sensors 33, 35 can communicate with a controller 36, and inform the controller 36 when a strand of dunnage material 7 is detected to start processing, for example by initiating the winding process. For example, the sensors 33, 35 may be optical sensors, such as light sensors, capacitive sensors, and/or ultrasound sensors. The controller, control system, and/or sensor(s) may include one or more processors and/or processing circuitry that is configured to perform the respective functions.

Furthermore, a closing mechanism not shown may be provided which can close and release a dispensing opening 37 for dispensing the processed strand of dunnage material 15, in particular the strand of dunnage material 15. As can be seen in particular in FIG. 2, the dispensing opening 37 is open in the vertical direction V so that the removal of the coil 15 of dunnage material can be carried out using gravity.

The winding device 3 and the adhesive tape dispenser 5 will be discussed in detail in connection with FIGS. 3 to 11.

Figure 3:
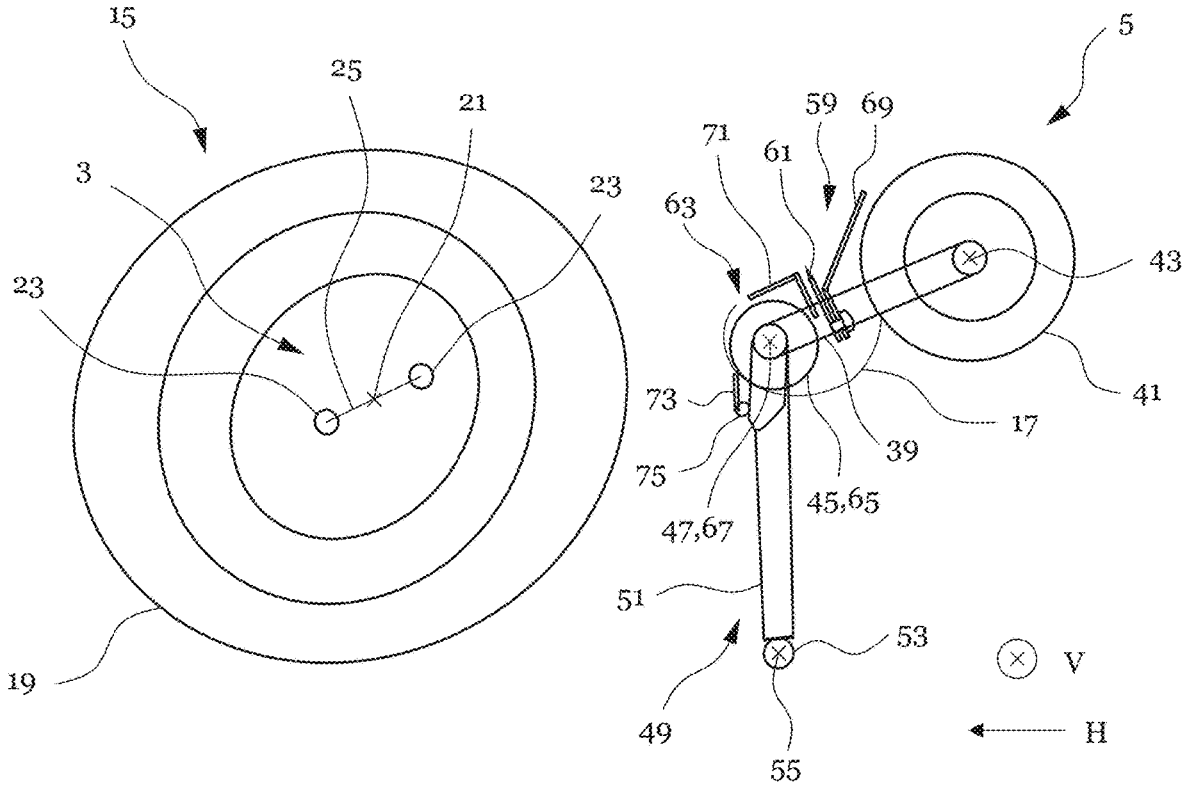
FIG. 3 is a schematic representation of a winding device and an adhesive tape dispensing device, according to an exemplary embodiment of the disclosure, in which the outer end layer is wound around the winding center and an adhesive tape dispensing device is in the resting state.

FIG. 3 shows a schematic representation of a winding device 3 and an adhesive tape dispensing device 5, in which the outer end layer 19 is wound around the winding center 21 and the adhesive tape dispensing device 5 is in the idle state. In particular, the adhesive tape dispensing device 5 includes an adhesive tape head 39 to which an adhesive tape supply 41 in the form of an adhesive tape roll 41 is attached. In this case, the adhesive tape roll 41 is mounted on the adhesive tape head 39 so as to be rotatable about its axis of rotation (roll axis) 43. Adhesive tape 17 is unwound from the adhesive tape roll and guided to a counter bearing 45, such as a deflection roller 45. In particular, the deflection roller may be rotatably mounted about an axis of rotation 47 of the deflection roller 45. In an exemplary embodiment, both the axis of rotation 47 of the deflection roller 45 and the axis of rotation 43 of the adhesive tape roll 41 are directed in the vertical direction V.

Figure 4:
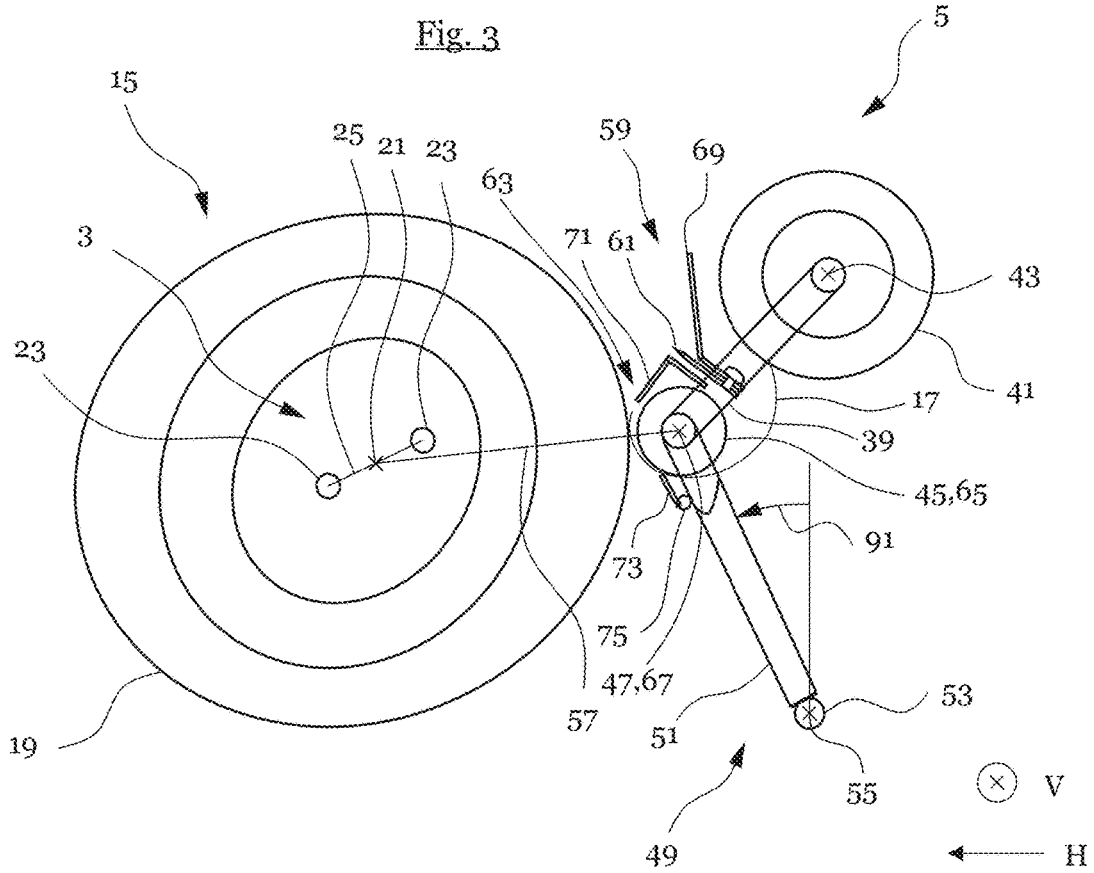
FIG. 4 is a schematic representation of a winding device and an adhesive tape dispensing device, according to an exemplary embodiment of the disclosure, in which the adhesive tape head is pivoted to the outer end layer.

As can be seen in particular in the comparison of FIGS. 3 and 4, the adhesive tape head 39 is movably mounted relative to the winding device 3. In particular, an adhesive tape swivel mechanism 49 is responsible for the movable mounting, which in FIGS. 3 to 6 is in the form of a rotatably mounted swivel arm 51 for swiveling the adhesive tape head 39 to the outer end layer 19 of the strand of dunnage material 9. For this purpose, the swivel arm 51 is attached at one end to the adhesive tape head 39 and is rotatably mounted at the other end. The rotationally movable mounting is implemented in particular by means of a swivel joint 53. In particular, the swivel joint 53 defines a swivel axis 55 of the adhesive tape swivel mechanism 49, about which the swivel arm 51 can be rotated. The swivel axis 55 of the adhesive tape swivel mechanism 49 is directed in particular in the vertical direction V. The adhesive tape head 39 is arranged in particular at a distance from the pivot axis 55, so that a rotary movement 91 of the pivot arm 51 causes the adhesive tape head 39 to pivot in the direction of the outer end layer 19. The pivoting movement can be affected by a rotary drive. In an exemplary embodiment, however, the pivoting movement is affected by a linear drive (not shown), which is arranged at a distance from the pivot axis 55 of the adhesive tape pivoting mechanism 49, so that a linear movement of the linear drive causes pivoting of the adhesive tape head 39.

As can be seen in particular in FIG. 4, the adhesive tape 17 is pressed against the outer end layer 19 via the counter bearing 45 when the adhesive tape head 39 is hinged to the outer end layer 19. In this case, the pressing force is affected in particular via the linear drive (not shown), which is articulated to the swivel arm 51. In an exemplary embodiment, a force vector with which the adhesive tape 17 is pressed against the outer end layer 19 via the counter bearing 45 is directed to the winding center 21. This can be realized in particular by the linear drive being arranged in the articulated state of the adhesive tape head 39 approximately parallel, preferably offset by at most 75°, 60°, 45°, 30°, 15°, 10°, or 5°, to a connecting line 57 between the axis of rotation 47 of the deflection roller 45 and the winding center 21. In an exemplary embodiment, the linear actuator, which is not shown, is directed in the horizontal direction H.

Figure 5:
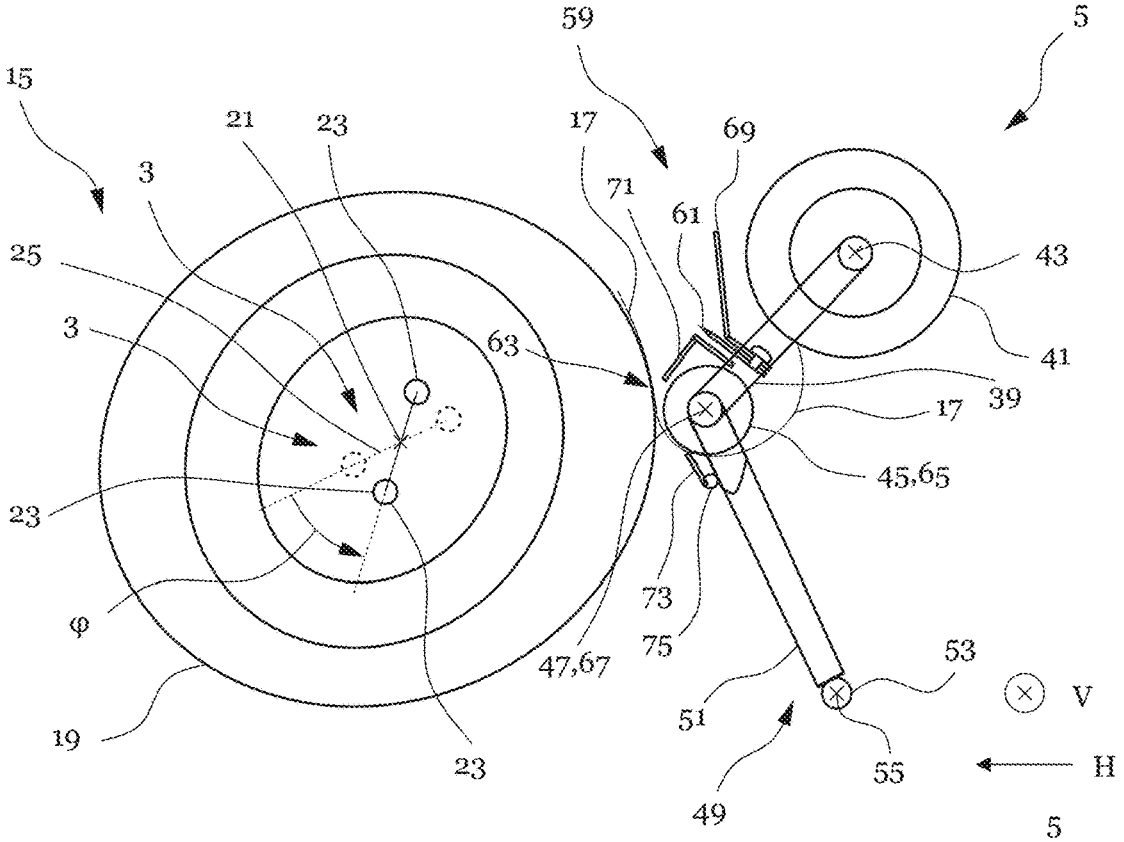
FIG. 5 is a schematic illustration of a winding device and an adhesive tape dispensing device, according to an exemplary embodiment of the disclosure, in which adhesive tape is applied to the outer end layer.

Following the bringing of the adhesive tape 17 to the outer end layer 19, adhesive tape 17 is wound around the outer end layer 19. As indicated in particular in FIGS. 5 and 6, the winding of the adhesive tape 17 around the outer end layer 19 is carried out by driving the winding device 3. In an exemplary embodiment, the winding device 3 is implemented by two deflectors 23 that can be rotated around the winding center. The deflectors 23 may be driven by a rotary drive, such as a three-phase motor. FIG. 5 shows a state in which the winding device 3 is rotated by a winding angle (p. As a result of the fact that the adhesive tape 17 is previously pressed against the outer end layer 19, in particular via the counter bearing 45, further adhesive tape 17 is unwound from the adhesive tape roll 41 by the rotary movement of the outer end layer 19.

A severing device 59 is provided for severing the adhesive tape 17 after it has been applied to the outer end layer 19. The severing device 59 has, in particular, a separator device 61, such as a cutting edge 61 for severing the adhesive tape 17 applied to the outer end layer 19. For this purpose, as shown in FIG. 6, a severing pivot mechanism 63 is provided. With the severing swivel mechanism 63, as shown in FIG. 6, the separator device 61 can be swiveled toward the outer end layer 19, so that the separator device 61 in particular cuts through the adhesive tape 17 applied to the outer end layer 19. In doing so, the separating device 61 moves in particular partially into the outer end layer 19. As can be seen in particular in the comparison between FIG. 5 and FIG. 6, the severing pivot mechanism 63 is formed in particular by a rotatable mounting of the adhesive tape head 39 on the pivot arm 51 of the adhesive tape pivot mechanism 49. In particular, the rotatable mounting is implemented by a swivel joint 65 which connects the adhesive tape head 39 to the swivel arm 51 so as to be rotatable relative to one another. The pivot axis 67 of the pivot joint 65 of the severing swivel mechanism 63 is directed in the vertical direction V. In an exemplary embodiment, the separating swivel mechanism 63 includes a linear drive, which is not shown, for guiding the separating device to the outer end layer 19. In particular, the linear drive is coupled to the separation pivoting mechanism 63 in such a way that a linear movement of the linear drive causes a rotational movement 92 of the separation device 61. In an exemplary embodiment, the linear actuator, which is not shown, is oriented substantially in the horizontal direction H. As shown in FIGS. 3 to 6, the adhesive tape pivoting mechanism 49 and the severing mechanism 63 may be implemented by a link chain. In this case, the link chain is implemented by having a first pivot joint 53 attached to the end of the pivot arm 51 facing away from the adhesive tape head 39 forming the adhesive tape pivot mechanism 49, while a second pivot joint 65 forms the link between the adhesive tape head 39 and the pivot arm 51, thereby forming the detachment pivot mechanism 63. In an exemplary embodiment, the axes of rotation 67 and 55 of the swivel mechanisms 49 and 63 are directed parallel to each other, in particular directed in the vertical direction V. In the embodiment shown here, the pivot axis 67 of the separation pivot mechanism 63 and the pivot axis 47 of the counter bearing 45 are directed coaxially with each other.

The severing device 59 further comprises a spring element 69, in particular a spring plate 69, which is arranged relative to the separator device 61 in such a way that a spring force is exerted on the adhesive tape 17 when the adhesive tape 17 is severed. In an exemplary embodiment, the spring plate and/or the separator device 61 are rigidly, in particular immovably, attached to the adhesive tape head 39. Furthermore, a second spring element 71 arranged on the opposite side of the separator device 61 may be provided for tensioning the adhesive tape 17. Furthermore, a spring-loaded application device 73 may be provided on the adhesive tape head 39 for applying the adhesive tape 17 to the counter bearing 45.

The application device 73 may be tensioned against the counter bearing 45 via a spring element 75, such as a spiral spring.

Figure 7:
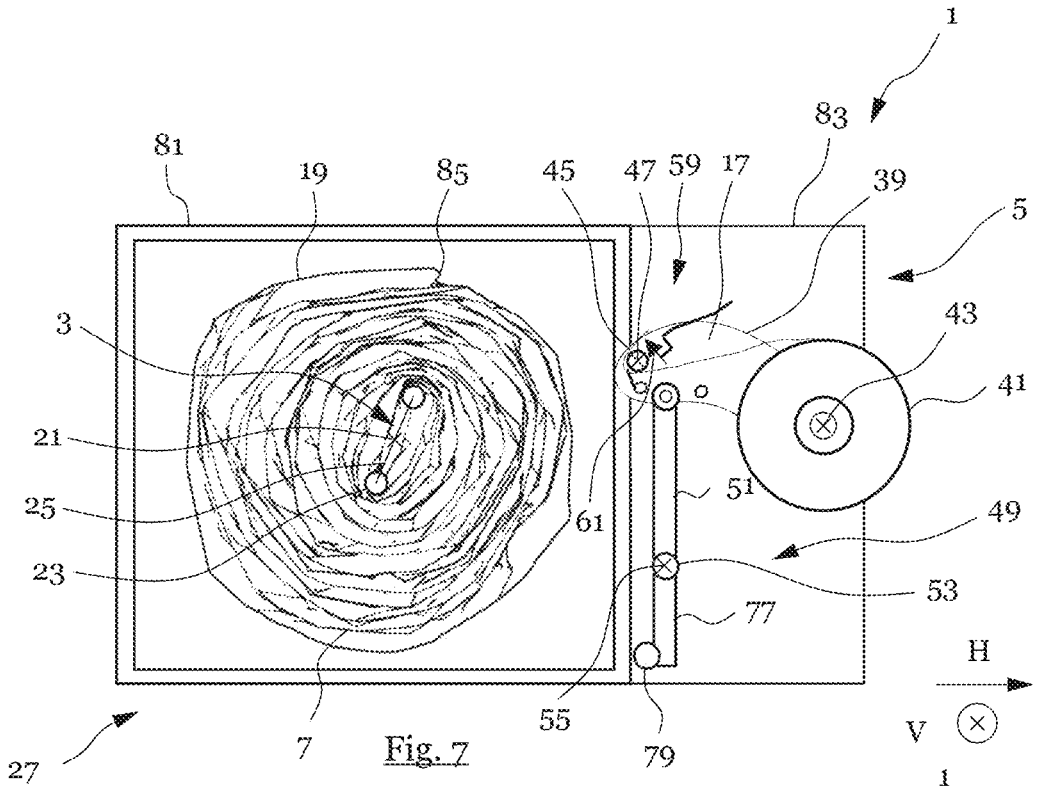
FIG. 7 is an alternative schematic representation of the processing state in FIG. 3 according to an exemplary embodiment of the disclosure.
Figure 8:
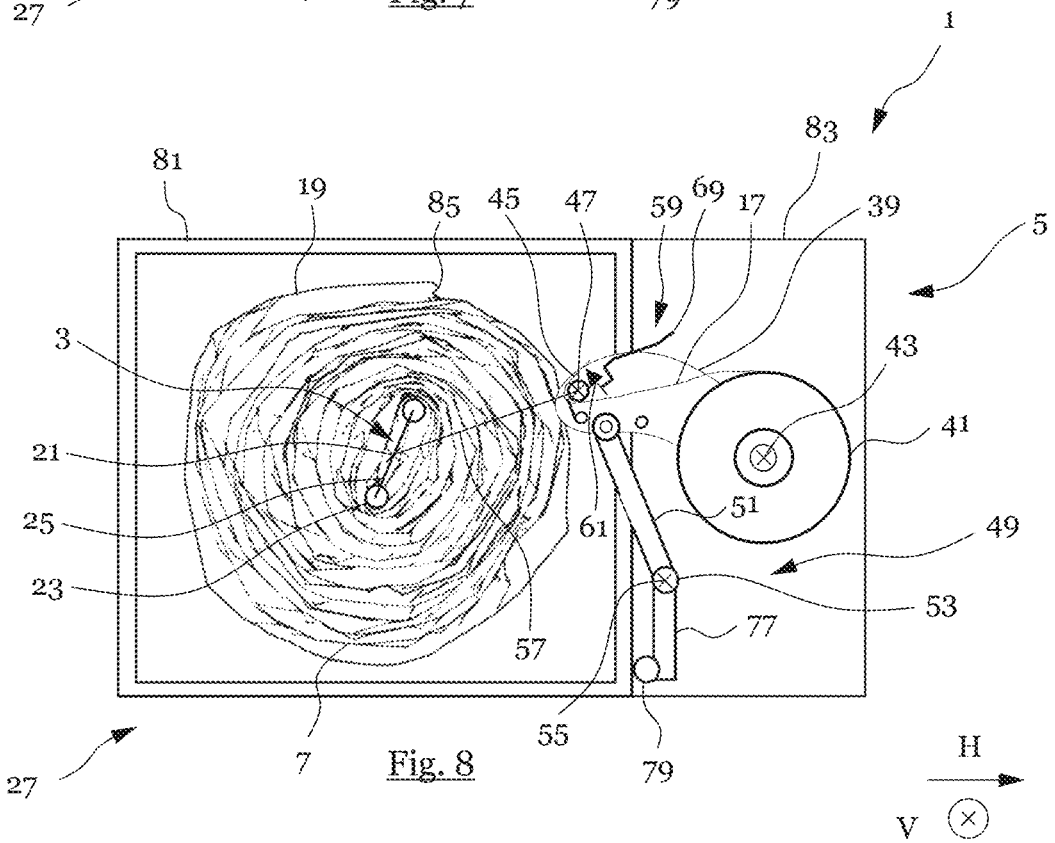
FIG. 8 is an alternative schematic representation of the processing state in FIG. 4, according to an exemplary embodiment of the disclosure.

FIGS. 7 to 9 show alternative schematic representations of a device 1 according to the disclosure in the processing states as shown in FIGS. 3, 4 and 6. The same or similar reference signs are used below for the same or similar components.

In the embodiment of the adhesive tape swivel mechanism 49 shown in FIGS. 7 to 9, the mechanism includes two swivel arms 51, 77. The first swivel arm 51 is connected to the adhesive tape head 39. Here, the first swivel arm 51 and the adhesive tape head 39 correspond essentially to the illustration in FIGS. 3 to 6. In addition, however, the swivel arm 51 is connected at its end facing away from the adhesive tape head 39 to a second swivel arm 77, which is rotatably connected to a device housing 27 via a second swivel joint 79 of the adhesive tape swivel mechanism 49. As a result, the amplitude of movement of the adhesive tape head 39 can be adjusted over a wider range and, in particular, can be adjusted by superimposing two pivoting movements.

As shown in FIGS. 7 to 9, the device housing 27 may divide the device into two chambers 81, 83. In this regard, a winding chamber 81 may be provided in which the winding of the strand of dunnage material 7 around the winding center 21 is performed. Further, an adhesive tape dispensing device chamber 83 may be provided in which the adhesive tape dispensing device 5 is in the resting state, and from which it may be pivoted out to apply the adhesive tape 17 to the outer end layer 19, as shown in FIGS. 8 and 9.

FIGS. 7 to 9 show an idealized state in which the outer end layer 19 already lies completely on the penultimate winding layer before the adhesive tape 17 is applied. However, as described above and indicated in particular in FIG. 1, it can also be said in particular that the outer end layer 19 is already wound around the winding center 21 with a dunnage material strand end 85 still protruding from the outer end layer 19.

FIG. 10.1 shows an alternative embodiment of the present disclosure in which the adhesive tape head 39 is brought to the outer end layer 19 by means of a linear drive 87. In this embodiment, an adhesive tape swivel mechanism 49 is dispensed with. Nonetheless, this embodiment also employs a detachment swivel mechanism 63, which is implemented in particular by a swivel joint 65 and a linear drive (not shown), as described previously. Instead of the swivel arm 51, in this embodiment the tape head 39 is connected to an actuator 89 of the linear actuator 87 via the swivel joint 65. Furthermore, it is shown in FIG. 10.1, as in FIGS. 7 to 9, that the swivel axis 67 of the swivel joint 65 of the cut-off swivel mechanism 63 can be arranged offset to the swivel axis 47 of the counter bearing 45.

FIG. 10.2 shows the embodiment shown in FIG. 10.1, but in contrast to FIG. 10.1, the tape supply 41 is decoupled from the movements of the tape head 39, so that the tape head 39 can be moved independently of the tape supply 41.

FIG. 11 shows an exemplary embodiment of the adhesive tape dispenser 5 with two swivel arms 51, 77, as shown in FIGS. 7 to 9. In it, the adhesive tape head is indicated in simplified form by the large circle 39. As indicated by the dashed lines, the feed movement can be flexibly adapted to the diameter of the outer end layer 19 by using two swivel arms, which is indicated in FIG. 11 with unevenness as a result of an elliptical shape of the processed strand of dunnage material. In this case, rotary movements 91, 93 of the swivel arms 51, 77 can be carried out individually or superimposed. In order to compensate for unevenness of the outer end layer 19 during application of the adhesive tape, it has been found advantageous to use a sensor 78 which is attached in particular to one of the swivel arms 51, 77, in particular to the swivel arm 51 which is connected to the adhesive tape head 39. In this context, the sensor is configured to detect unevennesses, in particular protrusions and/or protruding dunnage material strands, of the outer end layer 19. In an exemplary embodiment, the detected information is passed on to a control system (controller) 80 and/or a drive not shown, via which the rotary movements 91,93 of the swivel arms 51,77 are adapted to the unevennesses. Furthermore, such a sensor 78 can serve as a safety mechanism in which it is queried whether the adhesive tape dispensing device 5 is in the rest position before the winding process is started. Furthermore, such a sensor may be used to detect the intervention of an operator in the device and, in the event of such a detection, to interrupt processing or prevent processing from starting.

FIG. 12 shows an exemplary flow chart of the control of the various drives in an exemplary embodiment of the present disclosure. The time axis T shows the times at which the individual drives are activated. In FIG. 12 no quantitative information about the intensity of the drive of the individual drives is given. These are only indicated by step curves 51 to 55 with the information drive on or drive off, whereby a 1 of a step curve stands for a driven drive and a 0 of a step curve stands for a non-driven drive. From top to bottom, the step curve 51 represents the linear drive of the cut-off swing mechanism 65, the step curve S2 represents the linear drive of the adhesive tape swing mechanism 49, the step curve S3 represents a rotary drive of the winding device 3, the step curve S4 represents the drive of a closing mechanism, such as a roller shutter, for closing and releasing a discharge opening 37 for discharging a processed upholstery material strand 15, in particular an upholstery material winding 15, and the step curve 55 a drive of an upholstery forming machine 9 for forming a web-shaped starting material 11 into an upholstery material strand 7. Here, several, preferably all, of the drives are controlled and/or regulated by a control system. The control can be performed via input units, such as tablet computers or smartphones with standard applications, such as Bluetooth, WLAN and/or LAN, or with an integrated modem, based on transmission technologies, such as UMTS or LTE.

The time TO represents the actuation of the device 1 according to the disclosure. As a result of this actuation, the drive of the closing mechanism is controlled to close the dispensing opening 37. The time at which the dispensing opening 37 is closed is denoted by T1. Subsequently, if necessary with a certain time delay, the rotary drive of the winding device 3 is actuated in order to bring the deflectors 23 into a position in which the strand of dunnage material 7 can pass between them. The time at which the deflectors are in the desired position is designated T2. The drive of the dunnage forming machine 9 is started, insofar as necessary with a certain time offset, in order to form web-shaped starting material 11 into a dunnage material strand 7 and to transfer it to the device 1, in particular to feed it to the winding device 3, in particular to convey it between the two deflectors 23. Between the times T2 and T3, the strand of dunnage material 7 passes the sensors 33 and 35, with T3 marking the time, moreover, when the strand of dunnage material 7 has passed both sensors 33, 35, in particular the sensor 35 which is responsible for detecting the position on the winding device 3. As a result, the drive of the winding device 3 is started so that the strand of dunnage material 7 gets caught between the two deflectors and, as a result of the rotation of the deflectors 23, the strand of dunnage material 7 is wound around the winding center 21. The time T4 marks the time at which a predetermined length of the dunnage material strand 7 is produced by the dunnage forming machine 9 and this length is separated from the dunnage forming machine. Accordingly, at time T4, the drive of the cushion forming machine 9 is also switched off. Nevertheless, the winding process is continued in order to also wind the dunnage material strand sections remaining in the dunnage forming machine 9 around the winding center 21 until the outer end layer 19 is wound around the winding center 23 as well The time at which the outer end layer 19 is wound around the winding center is marked in particular as the time T5. At this point in time, the linear drive of the adhesive tape swiveling mechanism 49 is controlled so that it moves the adhesive tape head 39, in particular by converting the linear movement into a swiveling movement via the adhesive tape swiveling mechanism 49, towards the outer end layer 19, in particular in such a way that the adhesive tape contacts the outer end layer 19. By continuously driving the winding device 3, the adhesive tape 17 is consequently wound around the outer end layer 19 between the times T5 and T6. Time T6 marks the time at which the linear drive of the cut-off swivel mechanism 63 is actuated. In particular, the linear drive is coupled to the separating swivel mechanism in such a way that the linear movement causes a swivel movement of the separating device 61 in the direction of the outer end layer. The time T7 marks the time at which the spring element 69 of the release mechanism 59 comes into contact with the adhesive tape 17 and exerts an impulse on it, in particular tensions it. Time T8 marks the time at which the separating device 61 cuts through the adhesive tape 17 at the outer end layer. After the adhesive tape 17 has been severed, in particular the linear drive of the severing swivel mechanism 63 is driven in the opposite direction so that the severing device 59, in particular the separator device 61, is swiveled away from the outer end layer again at time T9. The time period between times T6 and T9 is adjustable via the control system and is set in particular to a time of 0.5 to 3 seconds, in particular 1 to 2 seconds.

Following the cutting process, the linear drive of the adhesive tape swivel mechanism 49 is also driven in the opposite direction in order to swivel the adhesive tape head 39 away from the outer end layer again. The point in time at which the adhesive tape head is swiveled back into the rest position is marked with the time T10. Between the time T10 and T10', the drive of the winding device is switched off in order to thereupon effect an acceleration of the winding device 3 in, in particular, the opposite winding direction, in particular a to-and-fro rotation of the winding device, by renewed driving of the drive of the winding device 3 between the times T10' and T11, in order to release the processed strand of dunnage material 15, in particular the coil 15 of dunnage material, from the winding device. In this case, the final speed corresponds approximately to the speed at which the first winding layer is wound around the winding center 21. This is particularly intended to assist in the removal of the processed strand of dunnage material 15 by utilizing the force of gravity. As soon as all drives come to a stop, which is indicated by the time T12, the drive of the closing mechanism is driven in the opposite direction in order to release the output opening 37 for the removal of the processed dunnage material strand 15, in particular the coil 15 of dunnage material.

The time T13 marks the point in time at which the output opening 37 is released again and a withdrawal can take place.

As can be seen in particular in FIG. 12, the application of the adhesive tape 17, as well as the removal of the adhesive tape can be carried out with the measures according to the disclosure without interrupting the winding process, whereby in particular the processing times can be reduced. Furthermore, by using gravity for the removal of the processed strand of dunnage material 15, in particular in combination with the acceleration of the same via the winding device 3, a removal of the processed strand of dunnage material 15 can be made possible without requiring an additional ejection mechanism and an additional drive associated therewith.

FIG. 13 shows a schematic representation of a strand of dunnage material 7 which is produced by a dunnage forming machine 9 from a web-shaped starting material 11 in such a way that an embossed deformation zone 95, in particular a wavy one, is formed centrally along the strand of dunnage material by the dunnage forming machine 9, which deformation zone 95 is laterally bounded by two, in particular substantially uniform, beaded edges 97. According to the disclosure, such a dunnage material strand 7 is wound into a coil 15 of dunnage material. Furthermore, an adhesive tape 17 extending in the longitudinal direction L of the strand of dunnage material 7 is applied to the outer end layer 19 of the strand of dunnage material 7 for fastening the outer end layer 19 to the strand of dunnage material 15. In this case, the adhesive tape 17 is arranged and dimensioned such that it covers the deformation zone 95 at least partially and a transition region 99 to one or both bead edges 97 of at least 2 mm in a contact-adhesive manner. The transverse extension of the strand of dunnage material 7 in the transverse extension direction Q is marked in particular with Q1 in FIG. 13. The transverse extension of the deformation zone 95 in the transverse extension direction Q is marked Q2. The transverse extension of the deformation zone 95 including the transition areas 99 in the transverse extension direction Q is marked Q3.

FIG. 14.1 shows a schematic representation of a linear drive 101 with guide rail 103 and carriage 104 before the adhesive tape head 39 is brought to the outer end layer (not shown in FIGS. 14.1 to 14.3). FIG. 14.2 shows a schematic representation of the linear drive of FIG. 14.1, whereby the adhesive tape head 39 and the carriage 105 have been moved in translation together, as indicated by the two arrows starting from the carriage 105 and from the adhesive tape head 39 in FIG. 14.1, compared to the representation in FIG. 14.1.

FIG. 14.2 is intended to represent the state in which the adhesive tape head 39 comes into contact with the outer end layer. In the contact area of the outer end layer and the adhesive tape head, a braking, in particular stopping, force acts on the adhesive tape head 39 from the outer end layer, which is indicated by the arrow pointing to the adhesive tape head 39. Due to the translatory support of the carriage 105 relative to the adhesive tape head 39, the carriage 105, as indicated by the arrow pointing away from the carriage 105, can continue the linear movement while the adhesive tape head 39 is braked, in particular stopped, by the outer end layer.

FIG. 14.3 shows a schematic representation of the linear drive of FIG. 14.2, whereby the carriage 105 is moved relative to the adhesive tape head 39 in the direction of the arrow pointing away from the carriage 105 in FIG. 14.2. This is made possible in particular by the translational mounting of the carriage 105 relative to the adhesive tape head 39. As indicated in FIG. 14.3, the carriage 105 and the adhesive tape head 39 are coupled to each other via a suspension 107, here in the form of a spiral spring 107, in such a way that the translatory relative movement between the carriage 105 and the adhesive tape head 39 causes compression of the spiral spring 107. This generates a spring force acting between the adhesive tape head 39 and the carriage 105, which causes a spring bias between the adhesive tape head 39 and the carriage 105. Further, the spring force may cause a contact force on the outer end layer via the adhesive tape head 39.

FIG. 15 shows a schematic representation of two possible adhesive tape monitoring devices 109, 111, namely an adhesive tape monitoring device 111 with an inductive sensor and an adhesive tape monitoring device 109 with an optical sensor. The inductive sensor detects a rotational movement of a shaft 113 rotatably supporting the adhesive tape roll 41 about the rotational axis 115 of the adhesive tape roll 41. The optical sensor is directed with the rotational axis 115 of the adhesive tape roll 41, in particular directed with the rotational axis 115 in a radial direction with respect to the rotational axis 115. Using the distance between the outer end layer 117, 119 and the sensor, the control of the adhesive tape monitoring device 109 determines the diameter of the adhesive tape roll 41.

In FIG. 15, an outer end layer 117 of a new adhesive tape roll is shown with solid lines and an outer end layer 119 of an adhesive tape roll is shown with dashed lines as an example, which represents the predetermined minimum diameter at which an alarm signal is triggered.

FIG. 16 shows a schematic representation of a strand diverter 121. In particular, the strand diverter 121 is rotatably mounted about an axis of rotation 123. In particular, the axis of rotation extends parallel to the direction of gravity G. In particular, the strand diverter 121 includes a tapering cross-section. In particular, the strand deflector 121 tapers in a cone-like manner. In particular, the strand diverter 121 tapers in the direction of gravity G.

The features disclosed in the foregoing description, the figures, and the claims may be significant, both individually and in any combination, for the realization of the disclosure in various embodiments.

To enable those skilled in the art to better understand the solution of the present disclosure, the technical solution in the embodiments of the present disclosure is described clearly and completely below in conjunction with the drawings in the embodiments of the present disclosure. Obviously, the embodiments described are only some, not all, of the embodiments of the present disclosure. All other embodiments obtained by those skilled in the art on the basis of the embodiments in the present disclosure without any creative effort should fall within the scope of protection of the present disclosure.

It should be noted that the terms "first", "second", etc. in the description, claims and abovementioned drawings of the present disclosure are used to distinguish between similar objects, but not necessarily used to describe a specific order or sequence. It should be understood that data used in this way can be interchanged as appropriate so that the embodiments of the present disclosure described here can be implemented in an order other than those shown or described here. In addition, the terms "comprise" and "have" and any variants thereof are intended to cover non-exclusive inclusion. For example, a process, method, system, product or equipment comprising a series of steps or modules or units is not necessarily limited to those steps or modules or units which are clearly listed, but may comprise other steps or modules or units which are not clearly listed or are intrinsic to such processes, methods, products or equipment.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

REFERENCE LIST

1 Device for processing a strand of dunnage material
3 winding device
5 adhesive tape dispensing device
7 dunnage material strand
9 dunnage forming machine
11 starting material web
13 container
15 coil of dunnage material winding/processed dunnage material strand
17 adhesive tape
19 outer end layer
21 winding center
23 deflector
25 connection line
27 device housing
29 strand access
33 sensor for position detection at strand access
35 sensor for position detection on the winding device
37 output opening
39 adhesive tape head
41 adhesive tape supply/adhesive tape roll
43 turning axis/roll axis of the adhesive tape roll
45 counter bearing/idler pulley
47 rotational axis
49 adhesive tape swivel mechanism
51 swivel arm of the adhesive tape swivel mechanism
53 swivel joint of the swivel arm
55 swivel axis of the adhesive tape swivel mechanism
57 line of connection between winding center and axis of rotation of the deflection roller in the hinged state of the tape head
59 severing device
61 separator device/cutter
63 separation swivel mechanism
65 swivel joint of the separation swivel mechanism
67 swivel axis of the cut-off swivel mechanism/swivel joint
69 spring element/spring plate
71 second spring element/spring plate
73 application device
75 spring element
77 second swivel arm of an adhesive tape swivel mechanism
78 sensor
79 second swivel joint of the adhesive tape swivel mechanism
81 winding chamber
83 tape dispensing equipment chamber
85 dunnage material strand end
87 linear drive
89 actuator of the linear actuator
91 rotational movement of the swivel arm 51
92 turning movement of the adhesive tape head 39
93 rotational movement of the swivel arm 77
95 deformation zone
97 beaded edges
99 transition area
101 linear drive
103 guide/guide rail
105 carriage
107 spring/spring/coil spring
109 optical tape monitoring device
111 inductive tape monitoring device
113 tape roll shaft/tape supply
115 rotational axis of the adhesive tape roll
117 outside end layer of a new adhesive tape roll
119 outside end layer of adhesive tape roll with predetermined minimum diameter
121 strand diverter
123 rotational axis of the strand diverter
Φ Winding angle
V vertical direction
H horizontal direction
T timeline
S step curves
L longitudinal direction of the cushioning material strand
G gravity direction
Q transverse extension direction of the cushioning material strand Q1 Transverse extension of the cushioning material strand
Q2 Transverse extension of the deformation zone
Q3 Transverse extension of the deformation zone including transition area

The invention claimed is:

1. A device for processing a strand of dunnage material into a coil of dunnage material, the dunnage material being produced by a dunnage forming machine from a web-shaped starting material, the device comprising:

a winding device configured to wind the strand of dunnage material around a winding center to form a wound strand of the dunnage material;

a linear drive including a carriage; and an adhesive tape dispenser coupled to the carriage and configured to dispense adhesive tape and apply the adhesive tape to the wound dunnage material, the adhesive tape dispenser comprising an adhesive tape head configured to linearly move and/or pivot towards an outer end layer of the strand of dunnage material to bring the adhesive tape to the outer end layer before applying the adhesive tape, wherein the adhesive tape head is configured to move toward the outer end layer by a linear motion prior to application to the outer end layer, wherein the adhesive tape dispensed by the adhesive tape dispensing device is applied to the outer end layer in response to the outer end layer being wound around the winding center, and wherein the adhesive tape head is brought to, based on a linear movement of the carriage towards the outer layer, the outer end layer via the carriage to bring the adhesive tape towards the outer end layer and into engagement with the outer end layer, a linear movement of the adhesive tape head being stopped by contact of the adhesive tape head with the outer end layer, while the carriage continues its linear movement, so that a relative movement is produced between the carriage and the adhesive tape head.

2. The device according to claim 1, wherein the adhesive tape head is movably mounted relative to the winding device, the adhesive tape head including:

an adhesive tape supply, and a deflection roller configured to press the adhesive tape onto the outer end layer, wherein the deflection roller is configured such that when applying adhesive tape to the outer end layer, the deflection roller is spring-damped such that the deflection roller follows a height profile of a circumferential course of the outer end layer.

3. The device according to claim 2, wherein the adhesive tape dispenser further comprises an adhesive tape pivoting mechanism configured to pivot the adhesive tape head to the outer end layer, wherein: the adhesive tape pivoting mechanism is spring-damped, and/or a pivot axis of the adhesive tape pivoting mechanism is directed in a vertical direction.

4. The device according to claim 2, wherein the adhesive tape dispenser further comprises:

an adhesive tape pivoting mechanism coupled to the linear drive, wherein: the adhesive tape pivoting mechanism is configured to pivot the adhesive tape head to the outer end layer such that a linear movement of the linear drive causes pivoting of the adhesive tape head, and/or a drive axis of the linear drive is oriented in a horizontal direction.

5. The device according to claim 2, wherein the linear drive further includes a guide rail, the carriage being translatory mounted relative to the guide rail, wherein:

the carriage is connected to the adhesive tape head such that the adhesive tape head is configured to follow a movement of the carriage, and/or a drive axis of the linear drive is directed in a horizontal direction.

6. The device according to claim 5, wherein the adhesive tape head is mounted translationally relative to the carriage in a same direction as the mounting of the carriage relative to the guide.

7. The device according to claim 6, wherein the adhesive tape head and the carriage are coupled to one another via a suspension such that a translatory relative movement between the carriage and the adhesive tape head is configured to cause a biasing force between the carriage and the adhesive tape head and/or causes a contact pressure of the adhesive tape head on the outer end layer.

8. The device according to claim 6, further comprising:

a sensor configured to detect a relative translatory movement between the adhesive tape head and the carriage; and a controller of the linear drive that is coupled to the sensor, the controller being configured to stop a movement of the linear drive in response to a detection of a predetermined relative movement, by the sensor, between the adhesive tape head and the carriage.

9. The device according to claim 2, further comprising a severing device movably mounted relative to the winding device, the severing device including a cutter configured to sever the adhesive tape applied to the outer end layer.

10. The device according to claim 9, wherein the severing device further comprises a severing pivot mechanism configured to pivot the cutter towards the outer end layer and through the adhesive tape to the outer end layer, wherein: the severing pivot mechanism is spring-damped, and/or a pivot axis of the severing pivot mechanism is oriented in a vertical direction.

11. The device according to claim 10, wherein:

the severing device is rigidly connected to the adhesive tape head, and/or the severing pivot mechanism is implemented by a pivotable mounting of the adhesive tape head relative to a pivot arm.

12. The device according to claim 9, wherein the severing device comprises:

a linear drive configured to guide the cutter to the outer end layer through the adhesive tape to the outer end layer, and a severing pivoting mechanism coupled to the linear drive such that a linear movement of the linear drive causes a pivoting movement of the severing device.

13. The device according to claim 9, wherein the severing device includes a spring plate arranged relative to the cutter such that spring plate is configured to exert a spring force on the adhesive tape to tension the adhesive tape when the adhesive tape is severed by the severing device.

14. The device according to claim 9, further comprising a controller configured to actuate the adhesive tape dispenser, the winding device, and/or the severing device.

15. A device for processing a strand of dunnage material produced from a web-shaped starting material, the device comprising:

a winding device configured to wind the strand of dunnage material around a winding center to form a wound strand of the dunnage material; and a linear drive including a carriage; and an adhesive tape dispenser coupled to the carriage and configured to apply adhesive tape to the strand of dunnage material, the adhesive tape dispenser comprising an adhesive tape head configured to linearly move and/or pivot towards an outer end layer of the wound strand to bring the adhesive tape to the outer end layer before applying the adhesive tape, wherein the adhesive tape dispenser and the winding device are arranged relative to each other such that the adhesive tape dispenser and the winding device are movable towards each other to apply the adhesive tape to the strand of dunnage material, the adhesive tape head being configured to move toward the outer end layer by a linear motion prior to application to the outer end layer, wherein the adhesive tape head is brought to, based on a linear movement of the carriage towards the outer layer, the outer end layer via the carriage to bring the adhesive tape towards the outer end layer and into engagement with the outer end layer, a linear movement of the adhesive tape head being stopped by contact of the adhesive tape head with the outer end layer, while the carriage continues its linear movement, so that a relative movement is produced between the carriage and the adhesive tape head.

16. The device according to claim 15, further comprising: a device housing configured to prevent unintentional interference with the winding device and/or the adhesive tape dispenser, the device housing including a strand access configured to allow access to an interior of the device housing and through which the strand of dunnage material is transferrable to the winding device.

17. The device according to claim 15, further comprising a position detector including a first sensor configured to detect a position at a strand access of the device and a second sensor configured to detect a position at the winding device, the position detector being configured to detect whether:

the strand of dunnage material is in engagement with the winding device;

an unintentional engagement occurs during processing of the strand of dunnage material in the winding device and/or in the adhesive tape dispenser; and/or a release of the processed strand of dunnage material takes place.

18. The device according to claim 15, further comprising at least one strand deflector configured to deflect the strand of dunnage material between a strand access and the winding device, wherein: the strand deflector is rotatably mounted about an axis of rotation extending in a direction of gravity, and/or the strand deflector includes a cross-sectional surface tapering in the direction of gravity.

19. The device according to claim 15, further comprising an adhesive tape monitor having a sensor configured to monitor the application of the adhesive tape to an outer end layer of the strand of dunnage material, wherein the sensor is configured to detect a rotational movement of an adhesive tape supply providing the adhesive tape.

20. The device according to claim 15, further comprising:

an adhesive tape monitoring device configured to monitor an adhesive tape consumption, the adhesive tape monitoring device including a sensor configured to detect a rotation of an adhesive tape supply providing the adhesive tape; and a controller configured to: convert the detected rotation into an adhesive tape consumption value, and generate an alarm signal in response to the adhesive tape consumption value reaching a predetermined adhesive tape consumption threshold value.

21. The device according to claim 15, further comprising:

an adhesive tape monitor configured to monitor an adhesive tape consumption, the adhesive tape monitor including an optical sensor configured to detect a diameter of an adhesive tape supply providing the adhesive tape; and a controller configured to monitor the detected diameter, and generate an alarm signal in response to the diameter falling below a predetermined minimum diameter.

22. The device according to claim 15, wherein an axis of rotation of the winding device is directed in a vertical direction; and/or the winding device includes at least two tines.

23. A method for processing a strand of dunnage material, with a dunnage processing device, produced from a web-shaped starting material, the method comprising:

winding, using a winding device, the strand of dunnage material around a winding center; and applying, using an adhesive tape head of a tape applicator, an adhesive tape to an outer end layer of the wound strand of dunnage material after the outer end layer has been wound around the winding center, wherein applying the adhesive tape comprises linearly moving and/or pivoting the adhesive tape towards the outer end layer to bring the adhesive tape to the outer end layer before applying the adhesive tape to the outer end layer, the adhesive tape head being moved toward the outer end layer by a linear motion prior to application to the outer end layer, wherein the adhesive tape head is coupled to a carriage of a linear drive and is brought to, based on a linear movement of the carriage towards the outer layer, the outer end layer via the carriage to bring the adhesive tape towards the outer end layer and into engagement with the outer end layer, a linear movement of the adhesive tape head being stopped by contact of the adhesive tape head with the outer end layer, while the carriage continues its linear movement, so that a relative movement is produced between the carriage and the adhesive tape head.

24. The method according to claim 23, further comprising:

detecting the relative movement between the adhesive tape head and the carriage; and interrupting the linear movement of the carriage in response to a detection of a predetermined relative movement between the adhesive tape head and the carriage.

25. The method according to claim 23, wherein the adhesive tape head is coupled to the carriage by a spring, the relative movement between the adhesive tape head and the carriage comprises: causing a biasing of the spring to cause a spring tensioning between the carriage and the adhesive tape head; and/or causing a contact force of the adhesive tape head on the outer end layer such that the adhesive tape head follows a height profile of a circumferential course of the outer end layer.

26. The method according to claim 23, further comprising:

before the application of the adhesive tape, detecting a radial extent of the outer end layer and adapting an approach movement of the adhesive tape to the outer end layer to the radial extent of the outer end layer, and/or detecting a circumferential position of a pad strand end to bring the adhesive tape into proximity of the pad strand end to reduce an adhesive tape requirement for fastening the pad strand end.

27. The method according to claim 26, wherein the radial extent of the outer end layer is detected continuously or sectionally during application of the adhesive tape to adapt a position of the adhesive tape and/or a force with which the adhesive tape is pressed against the outer end layer to the radial extent of the outer end layer.

28. The method according to claim 23, further comprising: severing the adhesive tape attached to the outer end layer after the adhesive tape is completely wound onto the outer end layer, wherein the severing of the adhesive tape is performed at the outer end layer.

29. The method according to claim 28, wherein the severing comprises moving a separator device towards a surface of the adhesive tape opposite an adhesive surface of the adhesive tape.

30. The method according to claim 28, further comprising tensioning the adhesive tape before severing the adhesive tape, wherein the tensioning includes: tensioning the adhesive tape tensioned around the outer end layer, and/or pressing the adhesive tape against the outer end layer.

31. The method according to claim 23, further comprising: accelerating the processed dunnage material strand in a winding direction and/or in a direction opposite to the winding direction after application of the adhesive tape to release the processed dunnage material strand from the dunnage processing device.

32. The method according to claim 23, wherein the adhesive tape extends in a vertical direction, which is parallel to a winding axis of the wound strand of dunnage material when applied to the outer end layer.

33. The method according to claim 23, wherein the winding is performed about a winding axis oriented in a vertical direction and/or is performed about at least two tines spaced from the winding axis.

34. The method according to claim 23, wherein the adhesive tape head is coupled to the carriage by a spring, the relative movement between the adhesive tape head and the carriage causing a biasing of the spring to cause a spring tensioning between the carriage and the adhesive tape head.

* * * * *